US006003601A

United States Patent [19]

Longbottom

[11] Patent Number: 6,003,601

[45] **Date of Patent: *Dec. 21, 1999**

[54] METHODS OF COMPLETING A SUBTERRANEAN WELL AND ASSOCIATED APPARATUS

[75] Inventor: James R. Longbottom, Whitesboro, Tex.

[73] Assignee: Halliburton Energy Services, Inc., Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/108,471

[22] Filed: Jul. 1, 1998

Related U.S. Application Data

[62] Division of application No. 08/791,204, Feb. 13, 1997, Pat. No. 5,845,707.

[51] Int. Cl.[6] ..... E21B 33/122

[52] U.S. Cl. ..... 166/313; 166/50; 166/117.6; 166/181; 166/384

[58] Field of Search ..... 166/50, 117.6, 166/181, 384, 313, 117.5

[56] References Cited

U.S. PATENT DOCUMENTS

| | | | |
|---|---|---|---|
| 2,336,334 | 2/1943 | J. A. Zublin . | |
| 2,336,338 | 12/1943 | J. A. Zublin . | |
| 5,458,209 | 10/1995 | Hayes et al. | 166/117.5 X |
| 5,499,681 | 3/1996 | White et al. | 166/208 X |
| 5,651,415 | 7/1997 | Scales | 166/50 X |
| 5,697,445 | 12/1997 | Graham | 166/50 X |

*Primary Examiner*—Roger Schoeppel
*Attorney, Agent, or Firm*—William M. Imwalle; Marlin Smith

[57] ABSTRACT

A method of completing a subterranean well and associated apparatus therefor provide efficient operation and convenience in completions where production of fluids from a lateral wellbore and a parent wellbore is desired. In one disclosed embodiment, the invention provides a method whereby a tubular member may be extended from a parent wellbore into a lateral wellbore, without the need of deflecting the tubular member off of a whipstock or other inclined surface. The tubular member may be previously deformed and initially constrained within a housing, so that as the tubular member extends outwardly from the housing, the tubular member is permitted to deflect laterally toward the lateral wellbore.

14 Claims, 25 Drawing Sheets

METHODS OF COMPLETING A SUBTERRANEAN WELL AND ASSOCIATED APPARATUS

This is a division of application Ser. No. 08/791,204, filed Feb. 13, 1997, now U.S. Pat. No. 5,845,707, such prior application being incorporated by reference herein in its entirety.

BACKGROUND OF THE INVENTION

The present invention relates generally to operations wherein a subterranean well is drilled and completed and, in a preferred embodiment thereof, more particularly provides a method and associated apparatus for drilling and completing a subterranean well.

It is well known in the art to drill an initial "parent" wellbore, and then to drill at least one "lateral" wellbore, that is, a wellbore intersecting and extending outwardly from the parent wellbore. Many methods and apparatus for drilling the lateral wellbore and for completing the parent and lateral wellbores have been conceived. For example, U.S. Pat. No. 4,807,704 to Hsu et al., discloses an apparatus and method wherein a whipstock is positioned in a cemented and cased parent wellbore to guide milling and drilling bits for forming the lateral wellbore, and the whipstock is then replaced with a guide member attached via a sealed conduit to a dual string packer. The guide member is utilized to guide a tubing string into the lateral wellbore after the guide member has been properly positioned in the parent wellbore and the packer has been set. The disclosure of U.S. Pat. No. 4,807,704 is hereby incorporated herein by this reference.

However, in keeping with the industry's efforts to provide advances in the state of this art, there is a need for more efficient, economical, convenient and safe methods and apparatus. From the foregoing, it can be seen that it would be quite desirable to provide a method and associated apparatus for completing a subterranean well which is generally economical and efficient in operation, and which provides increased functionality. It is accordingly an object of the present invention to provide such a method and associated apparatus. Other objects, features, and benefits of the present invention will become apparent upon careful consideration of the description hereinbelow.

SUMMARY OF THE INVENTION

In carrying out the principles of the present invention, in accordance with an embodiment thereof, a method is provided which enhances the efficiency of operations wherein it is desired to complete a subterranean well with multiple wellbore portions.

In broad terms, a method of completing a subterranean well having a junction of first, second and third wellbore portions is provided. The first wellbore portion extends to the earth's surface, and the method includes the steps of providing first and second elongated members, the first member being slidingly disposed relative to the second member; positioning the first and second members relative to the junction in the first wellbore portion; and extending the first member outwardly from the second member, the first member deflecting laterally toward the third wellbore portion as the first member progressively extends outwardly from the second member.

Also provided is another method of completing a subterranean well. The method includes the steps of drilling first and second wellbore portions, the second wellbore portion intersecting the first wellbore portion; installing a casing internally through the intersection of the first and second wellbore portions; installing a liner in the casing within the second wellbore portion, the liner having a first seal surface attached thereto; providing an assembly including a packer, a tubular structure attached to the packer, an orienting profile attached to the tubular structure, a second seal surface attached to the tubular structure, and a whipstock releasably attached to the packer; positioning the assembly in the second wellbore portion, the whipstock being proximate the intersection of the first and second wellbore portions; sealingly engaging the first and second seal surfaces; and setting the packer in the second wellbore portion.

Additionally apparatus for use in completing a subterranean well is provided by the present invention. The apparatus includes an anchoring device capable of securing the apparatus against displacement within the well; a first member attached to the anchoring device; and a second member axially slidingly disposed relative to the first member, the second member deflecting laterally when the second member is axially displaced relative to the first member.

DETAILED DESCRIPTION

Figure 1:
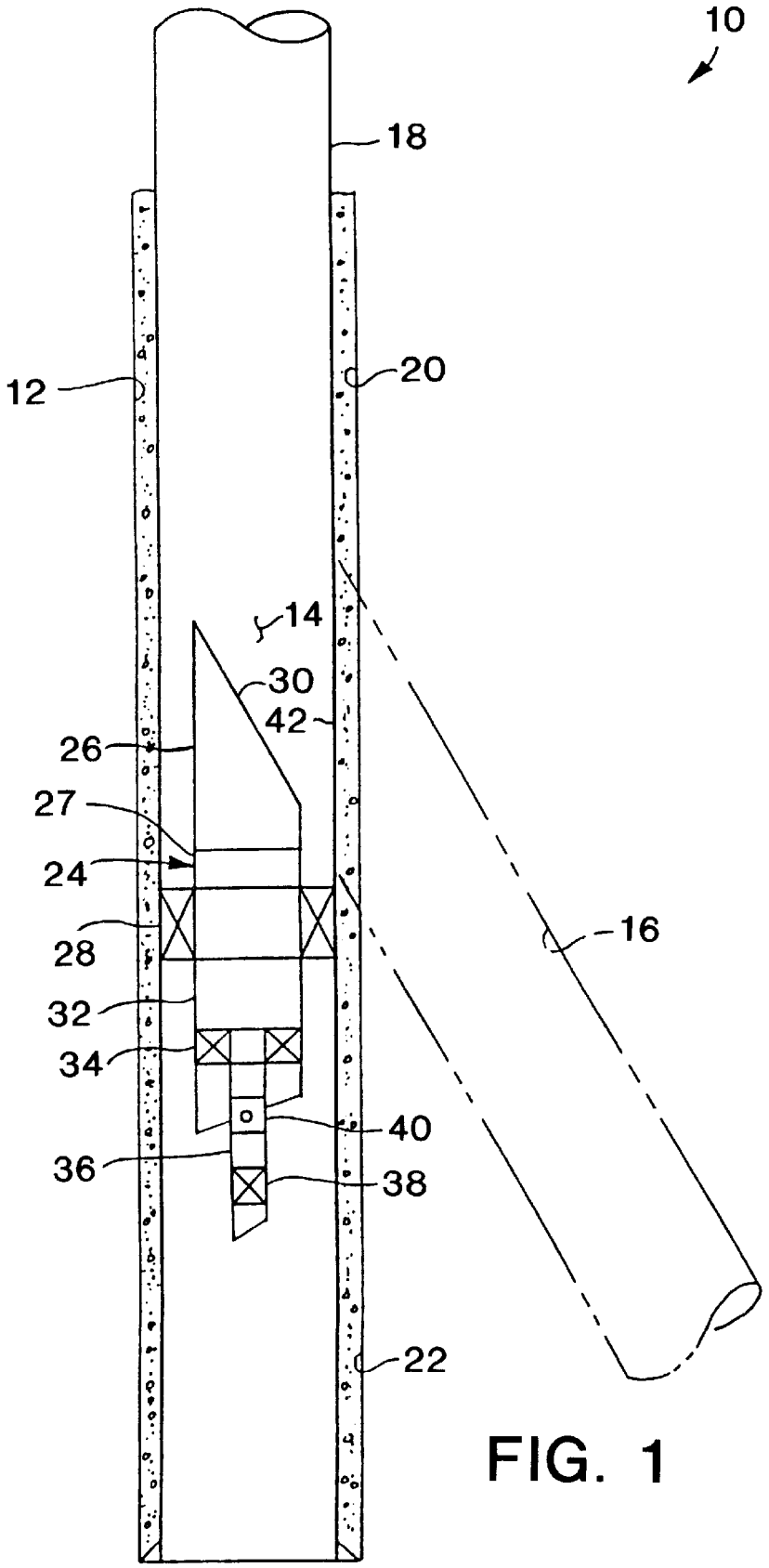
FIG. 1 is a schematic cross-sectional view of a subterranean well wherein an initial portion of a first method of completing the well has been performed, the method embodying principles of the present invention.

Schematically and representatively illustrated in FIG. 1 is a method 10 which embodies principles of the present invention. In the following description of this embodiment of the invention, directional terms, such as "above", "below", "upper", "lower", "upward", "downward", etc., are used for convenience in referring to the accompanying drawings. It is to be understood that the method 10 may be performed in orientations other than those depicted. For example, a parent wellbore, although being depicted as extending generally vertically, may actually be inclined, horizontal, or otherwise oriented, and a lateral wellbore intersecting the parent wellbore, although being depicted as extending generally horizontally, may actually be inclined, vertical, etc. Additionally, more than one lateral wellbore may be formed intersecting a single parent wellbore, according to the principles of the present invention.

FIG. 1 shows a cross-section of a well after some initial steps of the method 10 have been completed. An initial or parent wellbore 12 has been drilled, cemented, and cased or lined, both above and below a desired point of intersection 14 with a lateral wellbore 16 to be drilled later (the lateral welibore being shown in phantom lines in FIG. 1 as it is not yet drilled). The point of intersection 14 refers not to a discreet geometric point in the well, but rather to an area where the parent and lateral wellbores 12, 16 intersect. Casing 18 extends generally continuously through the upper and lower portions 20, 22 of the parent welbore 12.

An assembly 24 is conveyed into the parent wellbore 12 and positioned with respect to the point of intersection 14. The assembly 24 includes a whipstock 26 releasably attached to a packer 28. The packer 28 is set in the casing 18 so that an upper inclined face 30 formed on the whipstock 26 faces toward the desired lateral wellbore 16. In this respect, the whipstock 26 is generally of conventional design and, although the inclined face 30 is depicted as being flat, it may actually have a curvature, etc. The whipstock 26 may be attached to the packer 28 utilizing a conventional RATCH-LATCH® connection 27 manufactured by, and available from, Halliburton Company of Duncan, Okla., or other such releasable connection.

The packer 28 has a tubular member 32 extending downwardly therefrom. The tubular member 32 may be a joint of tubing, a polished bore receptacle, etc. Another packer 34 is set in the tubular member 32. Of course, if the tubular member 32 is a polished bore receptacle, the packer 34 may be replaced by a packing stack or other seals. Alternatively, the tubular member 32 may be a mandrel of the packer 28, and the packer 34 may be seals disposed therein. Thus, the packer 34 serves as a sealing device within, or suspended from, the packer 28.

The packer 34 has a tubing string 36 extending downwardly therefrom. The tubing string 36 includes a plug 38 and a sliding sleeve valve 40. The plug 38 serves as a flow blocking device for preventing fluid flow through the tubing string 36. The sliding sleeve valve 40 serves as a flow control device for selectively permitting fluid flow radially through the tubing string 36. In at least one embodiment of the present invention, which will be described in more detail hereinbelow, the tubing string 36, with its associated plug 38 and sliding sleeve valve 40, are not needed. However, where they are used in the method 10, the sliding sleeve valve 40 may be a DURASLEEVE® valve and the plug 38 may be a MIRAGE™ plug, both of which are manufactured by, and available from, Halliburton Company. In general, the sliding sleeve valve 40 is used to selectively open and close a fluid communication path between the tubing string 36 and the lower parent wellbore 22, for example, to test a packer after setting it, and the plug 38 is used to block fluid communication and physical access therebetween until it is desired to produce fluids from the lower parent wellbore.

Figure 2:
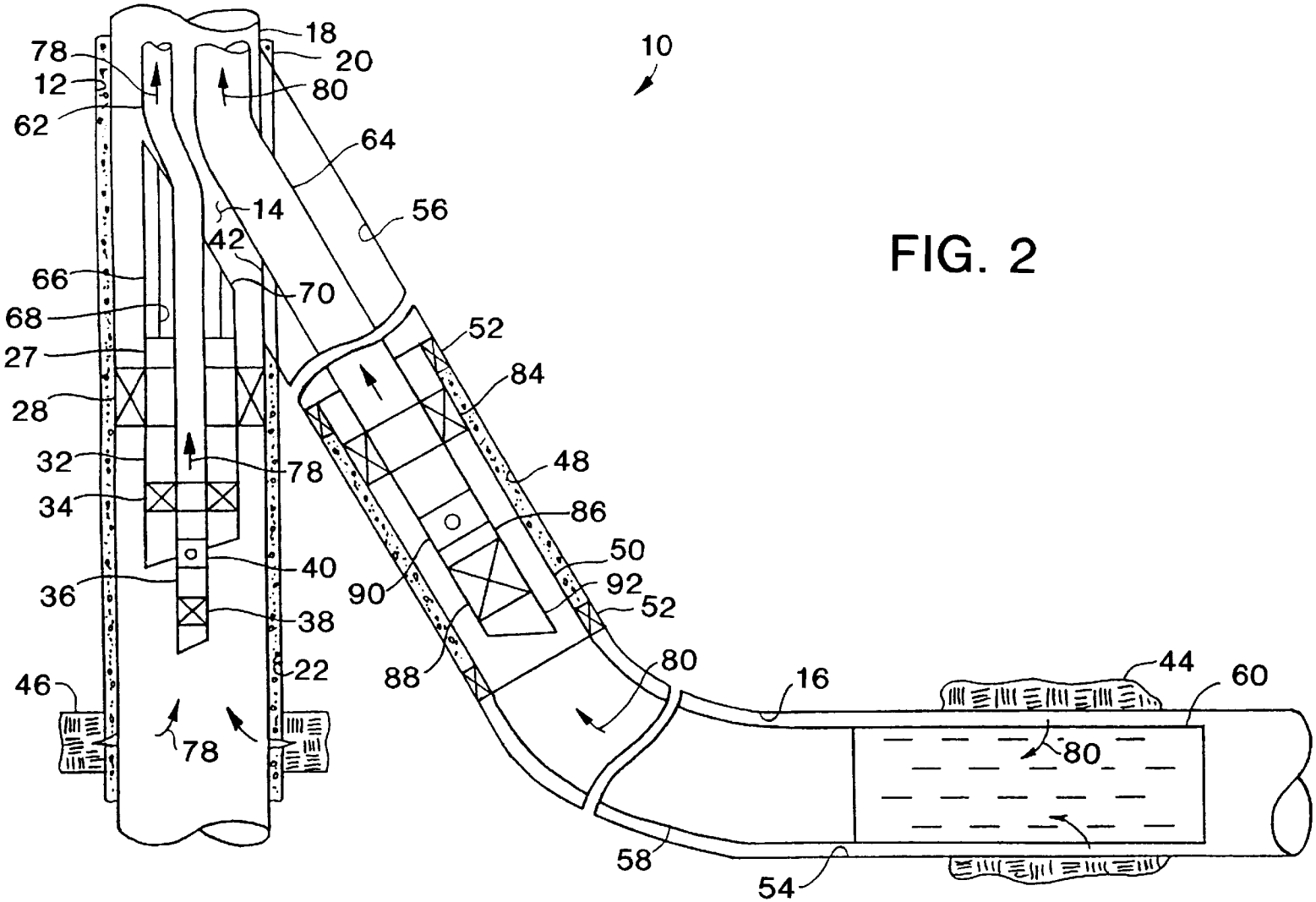
FIG. 2 is a schematic cross-sectional view of the well of FIG. 1 wherein further steps in the first method of completing the well have been performed.

With the assembly 24 positioned as shown in FIG. 1, and the packer 28 set in the casing 18, the lateral wellbore 16 may be drilled by, for example, deflecting a milling tool off of the face 30 and milling through a portion 42 of the casing, and then deflecting a drilling tool off of the face 30 to extend the wellbore 16 outwardly from the parent wellbore 12. FIG. 2 shows the lateral wellbore 16 after it has been drilled.

Referring now additionally to FIG. 2, the method 10 is schematically represented after additional steps have been performed. As described above, the lateral wellbore 16 has been drilled and now intersects a formation 44 from which it is desired to produce fluids. The lower parent wellbore 22 also intersects a formation 46 from which it is desired to produce fluids.

After the lateral wellbore 16 is drilled, all or a portion of it may be cased or lined and cemented, such as portion 48 of the lateral wellbore. In the representatively illustrated method 10, the portion 48 is lined and cemented by positioning a liner 50 therein and setting packers, cement retainers, or inflatable packers, etc., 52 straddling the portion 48. Cement may then be flowed between the liner 50 and wellbore 16, and permitted to harden, to thereby permit a lower portion 54 of the lateral wellbore 16 to be conveniently isolated from an upper portion 56 of the lateral wellbore.

Attached to the liner 50, and extending downwardly therefrom, a tubing string 58 may be positioned in the lateral wellbore 16. The tubing string 58 includes a slotted liner 60, but it is to be understood that perforated tubing, screens, etc., may be utilized in place of the slotted liner as well. Note that the liner 50 and tubing string 58 may be positioned in the lateral wellbore 16 simultaneously if desired.

The whipstock 26 is retrieved from the well prior to further steps in the method 10. The whipstock 26 is replaced with a hollow whipstock 66, similar to the whipstock 26, except that it has an axially extending bore 68 formed therethrough. Note that the hollow whipstock bore 68 is preferably not sealed at either end, and that it is circumscribed by a peripheral inclined surface 70. The hollow whipstock 66 may be attached to the packer 28 utilizing a RATCH-LATCH® 27, or other, connection, so that the surface 70 is oriented to face toward the lateral wellbore 16.

At this point, the method 10 may be continued in either of at least two manners, depending largely upon whether it is desired to commingle fluids produced from the formations 44, 46. The method 10 will first be described hereinbelow for use where such commingling is desired, and then the method will be described for use where commingling is not desired.

Figure 3A:
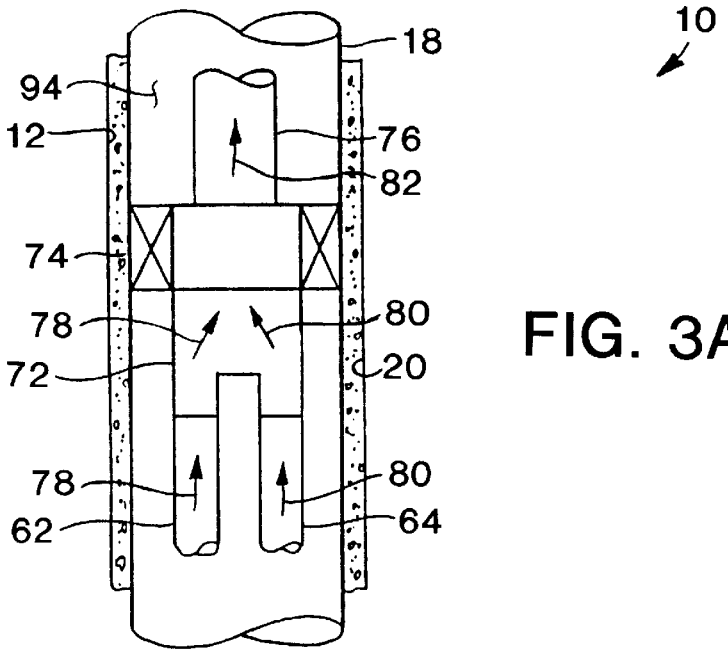
FIGS. 3A–3B are schematic cross-sectional views of the well of FIGS. 1 & 2 showing alternate configurations of apparatus utilized in the first method, the apparatus embodying principles of the present invention.

Two tubing strings 62, 64 are lowered simultaneously into the upper parent wellbore 20 from the earth's surface. Referring additionally now to FIG. 3A, it may be seen that the tubing strings 62, 64 are conveyed into the parent wellbore 12 attached to a wye or "Y" connector 72 which is, in turn, connected to a packer 74 and a tubing string 76 extending to the earth's surface. Note that flow from each of the tubing strings 62, 64 is commingled in the wye connector 72. As will be more fully described hereinbelow, tubing string 62 will be positioned in the lower parent wellbore 22 for production of fluid (indicated by arrows 78) from the formation 46, and tubing string 64 will be positioned in the lateral wellbore 16 for production of fluid (indicated by arrows 80) from the formation 44. The commingled fluids (indicated by arrow 82) are, thus, produced through the tubing string 76 to the earth's surface.

The tubing strings 62, 64 are conveyed into the parent wellbore 12 with both of them connected to the wye connector 72. Preferably, an axial length of the tubing string 64 from the wye connector 72 to a relatively large item of equipment included therein, such as a packer 84, is greater than the axial length of the tubing string 62. In this manner, relatively large diameter items of equipment included in the tubing string 64 do not have to be contained side-by-side with the tubing string 62 in the casing 18, thereby permitting such relatively large diameter equipment to be utilized in the lateral wellbore 16.

The tubing string 64 includes the packer 84 and a tubing string 86 extending generally downwardly therefrom. The tubing string 86 includes a flow blocking device or plug 88, a flow control device or sliding sleeve valve 90, and a member 92. In general, the plug 88 and sliding sleeve valve 90 are utilized for the same purposes as the plug 38 and sliding valve 40 of the tubing string 36. As described above for the tubing string 36, the MIRAGE™ plug and DURASLEEVE® sliding sleeve valve may be utilized for these items of equipment. Thus, when the tubing strings 62, 64 are being initially conveyed into the parent wellbore 12, the tubing string 62 is adjacent the tubing string 64, but above the packer 84. Note that, as represented in FIG. 2 and for illustrative clarity, the tubing string 64 appears to have a larger diameter than tubing string 62, but it is to be understood that either of the tubing strings may be larger than, or the same diameter as, the other one of them.

As the tubing strings 62, 64 are conveyed downward through the upper parent wellbore 20, eventually they will arrive at the point of intersection 14. The tubing string 64, being greater in length than tubing string 62, first arrives at the point of intersection 14. The member 92, attached to a lower end of the tubing string 64, contacts the inclined surface 70 and is deflected toward the lateral wellbore 16. The member 92 does not enter the bore 68 of the hollow whipstock 66, since the member is configured in a manner that excludes such entrance. For example, the member 92 may be a conventional mule shoe having an outer diameter greater than the diameter of the bore 68. It is to be understood that the member 92 and bore 68 may be otherwise configured to exclude entrance of the tubing string 64 therein, without departing from the principles of the present invention.

With the member 92 and, thus, the remainder of the tubing string 64 deflected toward the lateral wellbore 16, the tubing string 64 is further lowered so that the packer 84 enters the liner 50. The tubing string 62 is, of course, lowered simultaneously therewith, except that the tubing string 62 is permitted to enter, and displace axially through, the bore 68. The hollow whipstock 66, therefore, acts as a selective deflection member, selecting the tubing string 64 to be deflected over to the lateral wellbore 16, and selecting the tubing string 62 to be directed to the lower parent wellbore 22.

When the tubing string 62 has been conveyed into the lower parent wellbore 22, it is then brought into sealing engagement with the sealing device or packer 34. To accomplish such sealing engagement, the tubing string 62 may be fitted with seals for engagement with a seal bore carried on the sealing device 34, seals carried on the sealing device may engage a polished outer diameter formed on the tubing string 62, or any of a number of conventional methods may be used therefor. When the tubing string 62 is sealingly engaged with the sealing device 34, the packer 84 and tubing string 86 are appropriately positioned within the lateral wellbore 16. Preferably, the tubing string 62 is also connected to the packer 34, such as by use of a RATCH-LATCH® connection therebetween.

Fluid pressure may then be applied to the tubing string 76 at the earth's surface to set the packer 84 in the liner 50. As depicted in FIGS. 2 & 3A, and since the tubing strings 62, 64 are in fluid communication with each other, the plug 38 and sliding sleeve valve 40 should be closed while the packer 84 is being set (and, of course, the plug 88 and sliding sleeve valve 90 should be closed, also). Note that it is not necessary for the packer 84 to be set in the liner 50, but that the liner does provide a convenient location therefor. Alternatively, the packer 84 could be of the inflatable type and could be set in an unlined portion of the lateral wellbore 16.

With the packer 84 set in the lateral wellbore 16 and the tubing string 62 sealingly engaging the packer 34, further fluid pressure may be applied to the tubing string 76 to thereby set the packer 74 in the casing 18 in the upper parent wellbore 20. Again, the plugs 38, 88, and sliding sleeve valves 40, 90 should be closed while fluid pressure is applied to the tubing string 76 to set the packer 74. After the packer 74 has been set, fluids 78, 80 may be produced from the formations 46, 44, respectively, to the earth's surface through the tubing string 76 after opening desired ones of the plugs 38, 88 and/or sliding sleeve valves 40, 90. Note that the formations 44, 46 are both isolated from each other and from an annulus 94 between the tubing string 76 and the casing 18 extending to the earth's surface when packers 74, 84 are set and the tubing string 62 is sealingly engaged with the sealing device 34. Accordingly, the point of intersection 14 is also isolated from the lower parent wellbore 22, lower lateral wellbore 54, and the annulus 94, and, thus, it is not necessary to line and cement the upper lateral wellbore 56, since any formation intersected thereby is isolated from all other portions of the well.

Figure 3B:
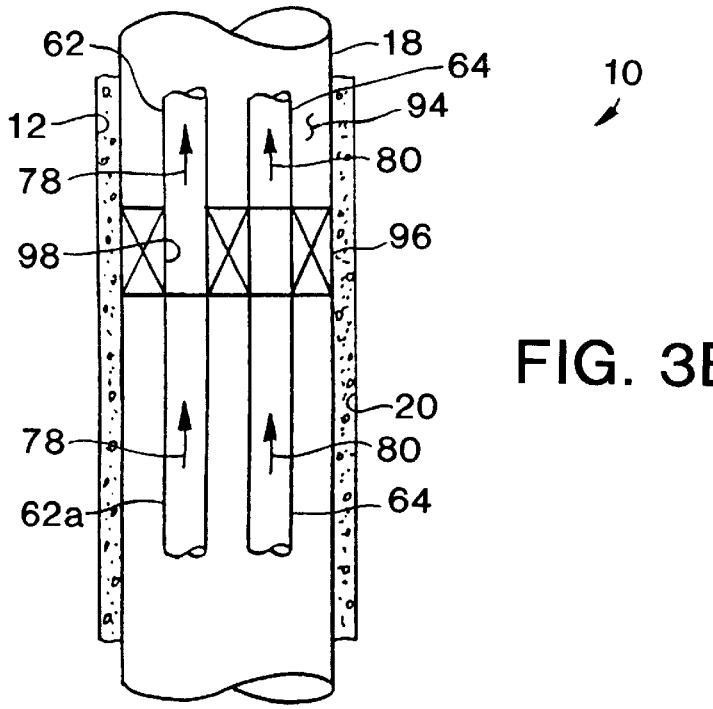
Figure 4:
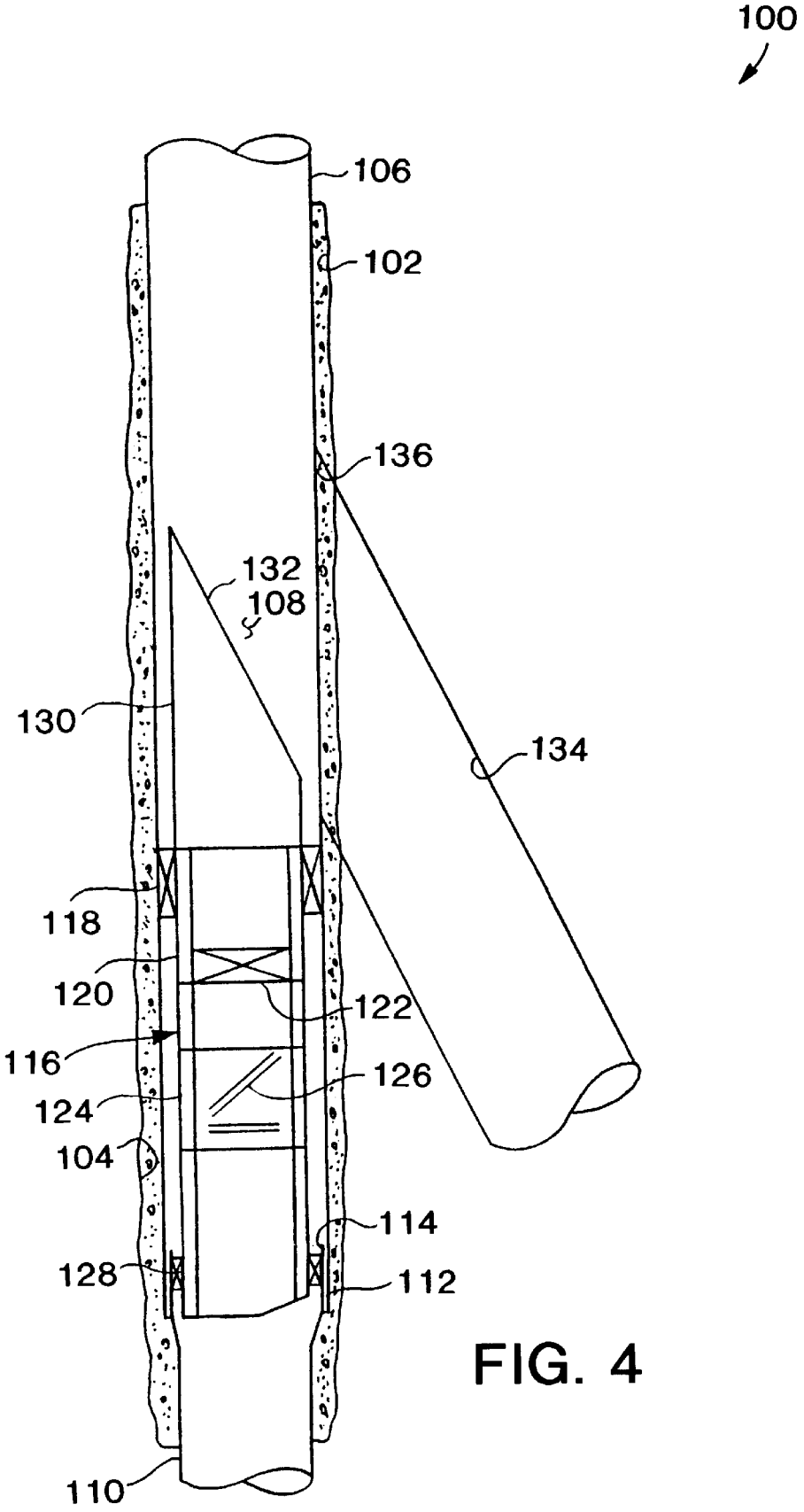
FIG. 4 is a schematic cross-sectional view of a subterranean well wherein an initial portion of a second method of completing the well has been performed, the method embodying principles of the present invention.
Figure 5:
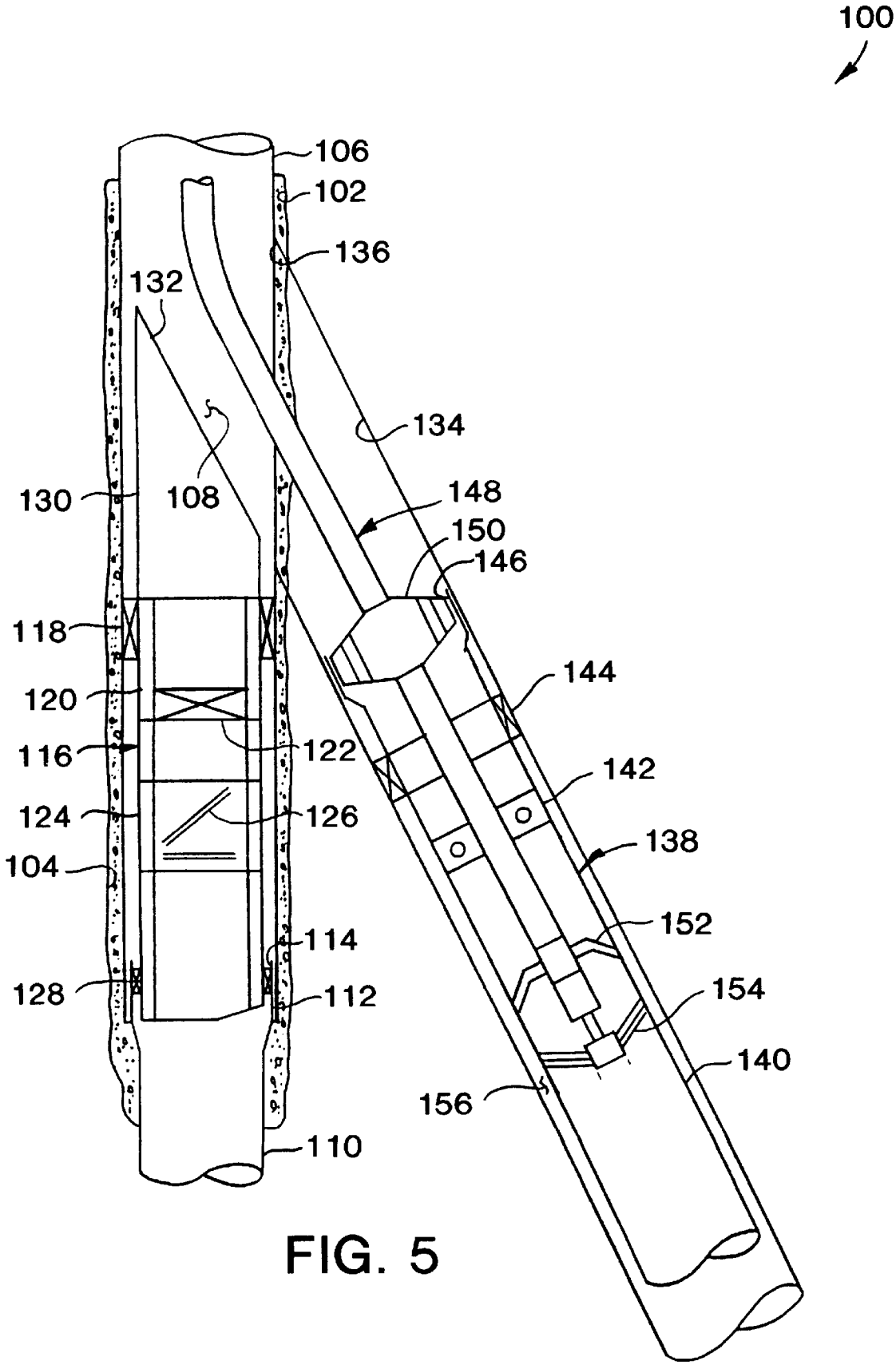
FIGS. 5–8 are a schematic cross-sectional views of the well of FIG. 4, wherein further steps in the second method of completing the well have been performed.

Referring additionally now to FIG. 3B, the method 10 will now be described for instances where it is desired to prevent commingling of the fluids 78, 80. In place of the packer 74 shown in FIG. 3A, a dual string packer 96 is utilized to permit separate fluid paths therethrough. The dual packer 96 is conveyed into the parent wellbore 12 as a part of the tubing string 64. The tubing string 62 is separately conveyed into the well, after the tubing string 64 is positioned within the lateral welibore 16 and the packers 84, 96 have been set as described hereinbelow.

Alternatively, the tubing string 64 and a lower portion 62*a* of the tubing string 62 may be conveyed into the wellbore 12, with the lower portion 62*a* attached to the dual string packer 96. In that case, the remainder of the tubing string 62 would be sealingly inserted into the dual string packer 96 (such as into a conventional scoop head thereof) after the tubing strings 64, 62*a* have entered their respective wellbores 16, 22 (as described above for the tubing strings 62, 64 in the method 10 as depicted in FIG. 3A) and the dual string packer has been set in the wellbore. The following further description of the method 10 as depicted in FIG. 3B describes the tubing string 62, including its lower portion 62*a*, as being separately conveyed into the well.

With the hollow whipstock 66 attached to the packer 28 and oriented as described above, the tubing string 64, including the dual string packer 96, packer 84, and tubing string 86, is lowered into the upper parent wellbore 20. Eventually, the member 92 contacts the hollow whipstock 66 and is deflected toward the lateral wellbore 16. The tubing string 64 is lowered further, until it is appropriately positioned within the lateral wellbore 16.

Fluid pressure is applied to the tubing string 64 at the earth's surface to set the packer 84 in the liner 50. Further fluid pressure may then be applied to set the dual string packer 96 in the casing 18.

With the packers 84, 96 set, the tubing string 62 may then be conveyed into the parent wellbore 12. As the tubing string 62 is lowered in the well, it eventually passes through a bore 98 of the dual string packer 96 in a conventional manner, reaches the point of intersection 14, and is permitted to pass through the bore 68 of the hollow whipstock 66. Thus, even when the tubing string 62 is installed after the tubing string 64, the hollow whipstock 66 is still capable of serving as a selective deflection member.

The tubing string 62 is further lowered into the lower parent wellbore 22, until it sealingly engages the sealing device 34 as described hereinabove. The tubing string 62 is also preferably connected to the sealing device 34 as described above. The tubing string 62 also sealingly engages the dual string packer bore 98 in a conventional manner. Note, however, that, since the tubing strings 62, 64 are not in fluid communication with each other, the plug 38 or sliding sleeve valve 40 need not be closed when the packer 84 is set and, in fact, the plug 38 or sliding sleeve valve 40 need not be included in the tubing string 36. Indeed, it will be readily apparent to one of ordinary skill in the art that, if appropriately configured, instead of sealingly engaging the sealing device 34, the tubing string 62 could directly sealingly engage the tubular member 32, thereby eliminating the packer 34 and tubing string 36 altogether.

With the packers 84, 96 set in the liner 50 and casing 18, respectively, and with the tubing string 62 sealingly engaging the packer 34 (or tubular member 32) and packer bore 98, the fluids 78, 80 from the formations 46, 44, respectively, may be flowed separately to the earth's surface after opening desired ones of the plugs 38, 88 and/or sliding sleeve valves 40, 90. As with the method 10 as described above in relation to FIG. 3A, the formations 44, 46 are both isolated from each other and from the annulus 94 between the tubing strings 62, 64 and the casing 18 extending to the earth's surface above the packer 96, and the point of intersection 14 is isolated from the lower parent wellbore 22, lower lateral wellbore 54, and the annulus 94.

Thus has been described the method 10, which, in association with uniquely configured apparatus, permits relatively large items of equipment, such as packer 84 and tubing string 86, to be installed in the lateral wellbore 16 whether the tubing strings 62, 64 are installed simultaneously or separately, which requires few trips into the well, which is convenient, economical, and efficient in its operation, and which permits automatic selection of tubing strings to be deflected (or not deflected) into appropriate wellbores. Referring additionally now to FIGS. 4–8, a method 100 is representatively and schematically illustrated, the method embodying principles of the present invention. As depicted initially in FIG. 4, some steps of the method 100 have already been performed. A first wellbore portion 102 extending to the earth's surface has been drilled. A second wellbore portion 104, which intersects the first wellbore portion 102, has also been drilled.

A liner or casing 106 has been installed in the first and second wellbore portions 102, 104, the casing extending internally through the junction or intersection (indicated generally at 108) of the first and second wellbore portions. Another liner or casing 110 has been installed in the second wellbore portion 104, such as by attaching the liner 110 within the casing 106 by using a conventional liner hanger 112. Attached to the liner 110 is a seal surface 114, which may be, for example, a seal bore, a polished bore receptacle, a packing stack or other seal, etc. The liner 110 and casing 106 are cemented in place within the first and second wellbore portions 102, 104 as shown, using conventional techniques.

An assembly 116 is then conveyed into the well adjacent the junction 108. The assembly 116 includes a packer 118 or other circumferential sealing device, a tubular structure 120 (which may be a separate tubular member, a mandrel of the packer, etc.) attached to the packer, a plug 122, a conventional nipple 124 having an orienting profile 126 formed therein, a seal surface 128 (which may be, for example, an external seal or polished seal surface, a packing stack, a seal bore, etc.), and a whipstock 130 releasably attached to the packer 118, for example, by utilizing a RATCH-LATCH®. The whipstock 130 is positioned so that an inclined surface 132 formed thereon is adjacent the junction 108 and faces radially toward a desired third wellbore portion 134.

The seal surface 128 sealingly engages the seal surface 114. The packer 118 is then set in the second wellbore portion 104 to anchor the assembly 116 therein, and to sealingly engage the assembly with the casing 106. An opening 136 is milled through the casing 106 by deflecting a cutting tool (not shown) off of the whipstock inclined surface 132. The third wellbore portion 134 is then drilled, so that the third wellbore portion extends outwardly from the opening 136, the third wellbore portion, thus, intersecting the first and second wellbore portions 102, 104 at the junction 108.

Another assembly 138 (see FIG. 5) is then positioned in the well. The assembly 138 includes a liner or casing 140, a valve 142 (for example, a conventional valve used in cementing staged operations, etc.), a packer 144 (for example, an inflatable external casing packer), and a seal surface 146 (for example, a seal bore, a polished bore receptacle, a packing stack, etc.). As will be more fully described hereinbelow, the assembly 138 may also include a tubular drilling guide (not shown in FIG. 5, see FIG. 9) attached to the liner 140 and extending upwardly therefrom into the first wellbore portion 102. In that case, a lower end of the tubular drilling guide may sealingly engage the seal surface 146.

The assembly 138 is positioned within the well with the packer 144 being disposed within the third wellbore portion 134. The packer 144 is set in the third wellbore portion 134 to thereby anchor and sealingly engage the assembly 138 within the third wellbore portion. Such positioning of the assembly 138 may be accomplished, for example, by suspending the assembly from a running string 148 having a conventional liner running tool 150, and conveying the running string and assembly into the well. The running string 148 may also include conventional cementing tools, such as a cup packer 152 and a scraper 154.

When the assembly 138 is appropriately positioned within the third wellbore portion 134 and the packer 144 has been set, the valve 142 is opened and cement (or other cementations material) is pumped from the earth's surface, through the running string 148, and into an annulus 156 radially between the liner 140 and the third wellbore portion 134. The valve 142 is closed and the cement is then permitted to harden in the annulus 156.

The running string 148 is then disengaged from the assembly 138, for example, by disengaging the running tool 150 from the assembly. If a drilling guide was attached to the assembly 138, the third wellbore portion 134 may be extended by passing a cutting tool through the drilling guide, through the liner 140, and drilling into the earth. When the drilling operations are completed, the drilling guide may be disconnected from the assembly 138 and retrieved to the earth's surface.

Figure 6:
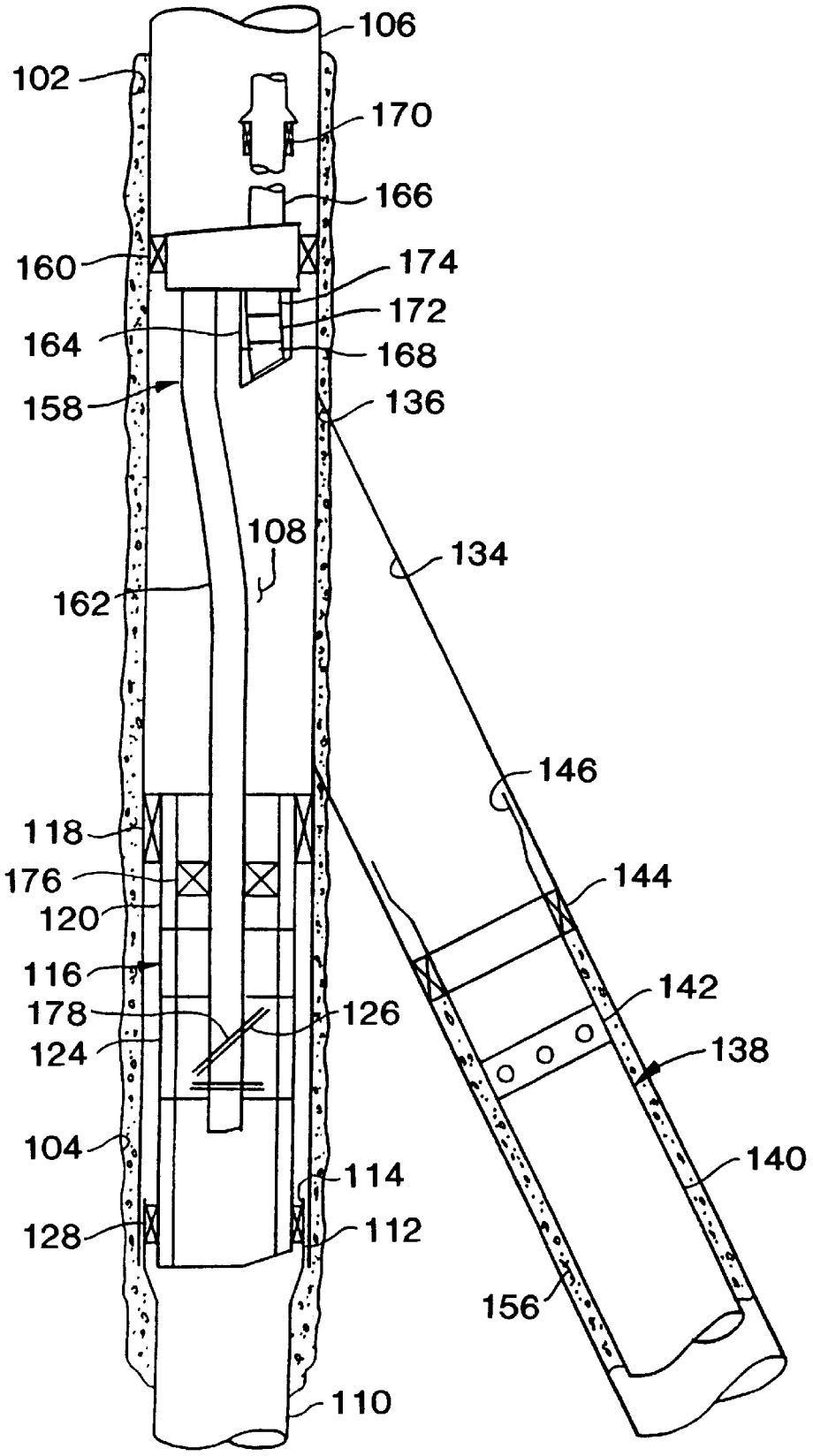
Figure 7:
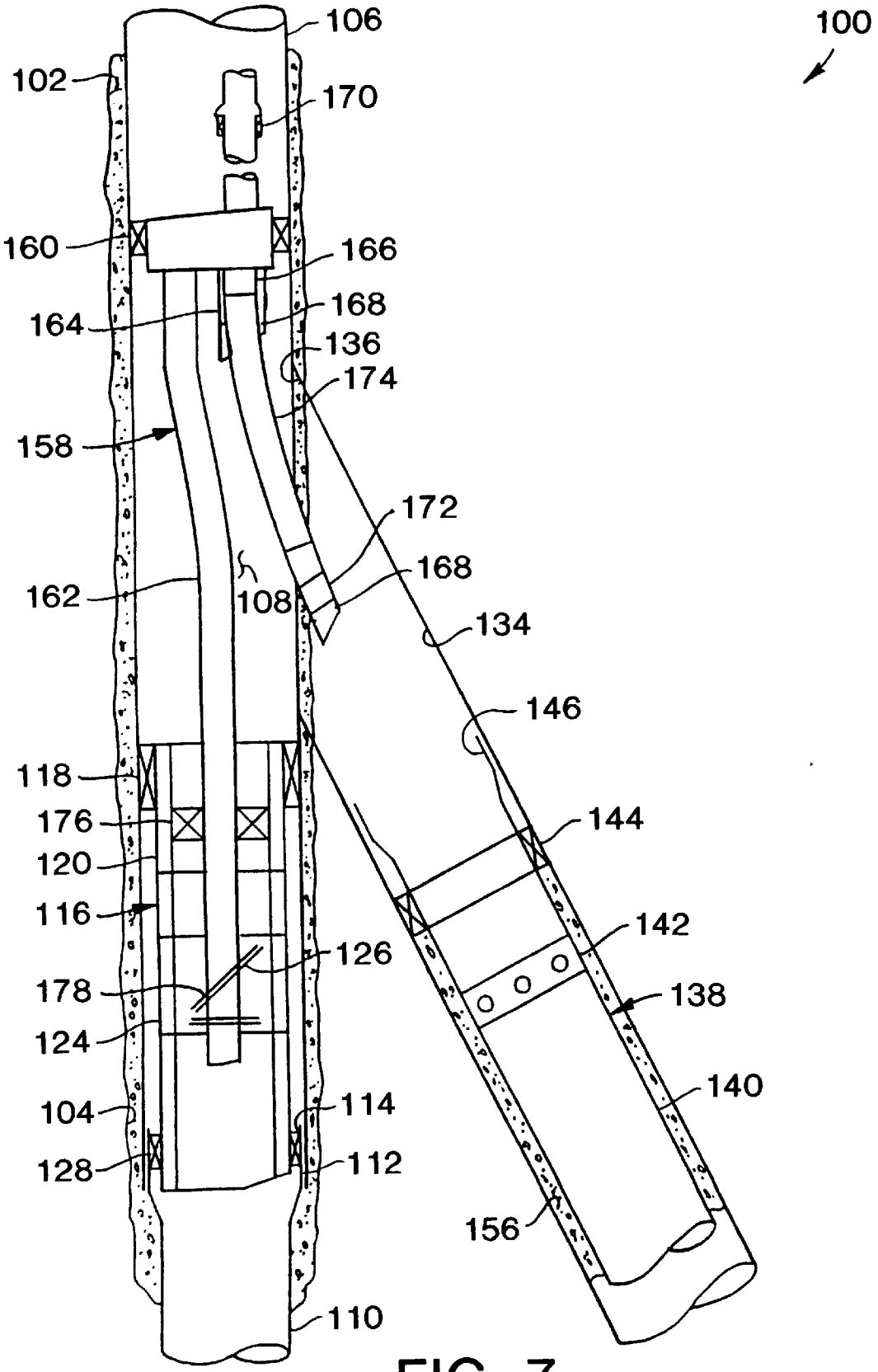

The whipstock 130 is then retrieved by detaching it from the packer 118 (see FIG. 6). The plug 122 is also retrieved from the well, thereby permitting fluid communication axially through the remainder of the assembly 116, from the interior of the liner 110 to the junction 108.

Another assembly 158 is conveyed into the well. The assembly 158 includes a multiple bore packer 160 (for example, a dual string packer), a tubing string 162 connected to the packer and extending downwardly therefrom, a housing 164 also connected to the packer and extending downwardly therefrom, a tubular member 166 extending through a bore of the packer and telescopingly received in the housing and releasably attached thereto (for example, by shear pins 168) a seal surface 170 (for example, a polished seal surface, a packing stack or other circumferential seal, etc.) near an upper end of the tubular member, and another seal surface 172 (for example, a packing stack, a packer, a polished seal surface, etc.) near a lower end of the tubular member. Preferably, the tubular member 166 includes a previously deformed or bent portion 174, which is at least somewhat straightened due to being laterally constrained within the housing 164.

The tubing string 162 includes a seal surface 176 (for example, a polished seal surface, a packing stack or other circumferential seal, etc.) and an orienting surface 178 configured for cooperative engagement with the orienting profile 126. The assembly 158 is positioned in the well, so that the orienting surface 178 engages the orienting profile 126, thereby radially orienting the assembly in the well with the housing 164 being disposed toward the opening 136, and the seal surface 176 is sealingly engaged with the tubular structure 120. The packer 160 is then set in the casing 106 in the first wellbore portion 102.

The tubular member 166 is released for displacement relative to the housing 164 by, for example, applying sufficient downwardly directed force to the tubular member to shear the shear pins 168. Means other than shear pins for preventing premature displacement as are of course well known in the art may also be used. The tubular member 166 is then extended outwardly (i.e., downwardly as viewed in FIG. 7) from the housing 164. If the tubular member 166 includes the previously deformed portion 174, such outward extension will cause the tubular member to deflect laterally toward the opening 136, since the previously deformed portion will no longer be laterally constrained by the housing 164. Alternatively, the housing 164 may be fitted with a device (such as rollers, etc., not shown in FIG. 7), which laterally deflects the tubular member 166 as it is extended outwardly from the housing.

Figure 8:
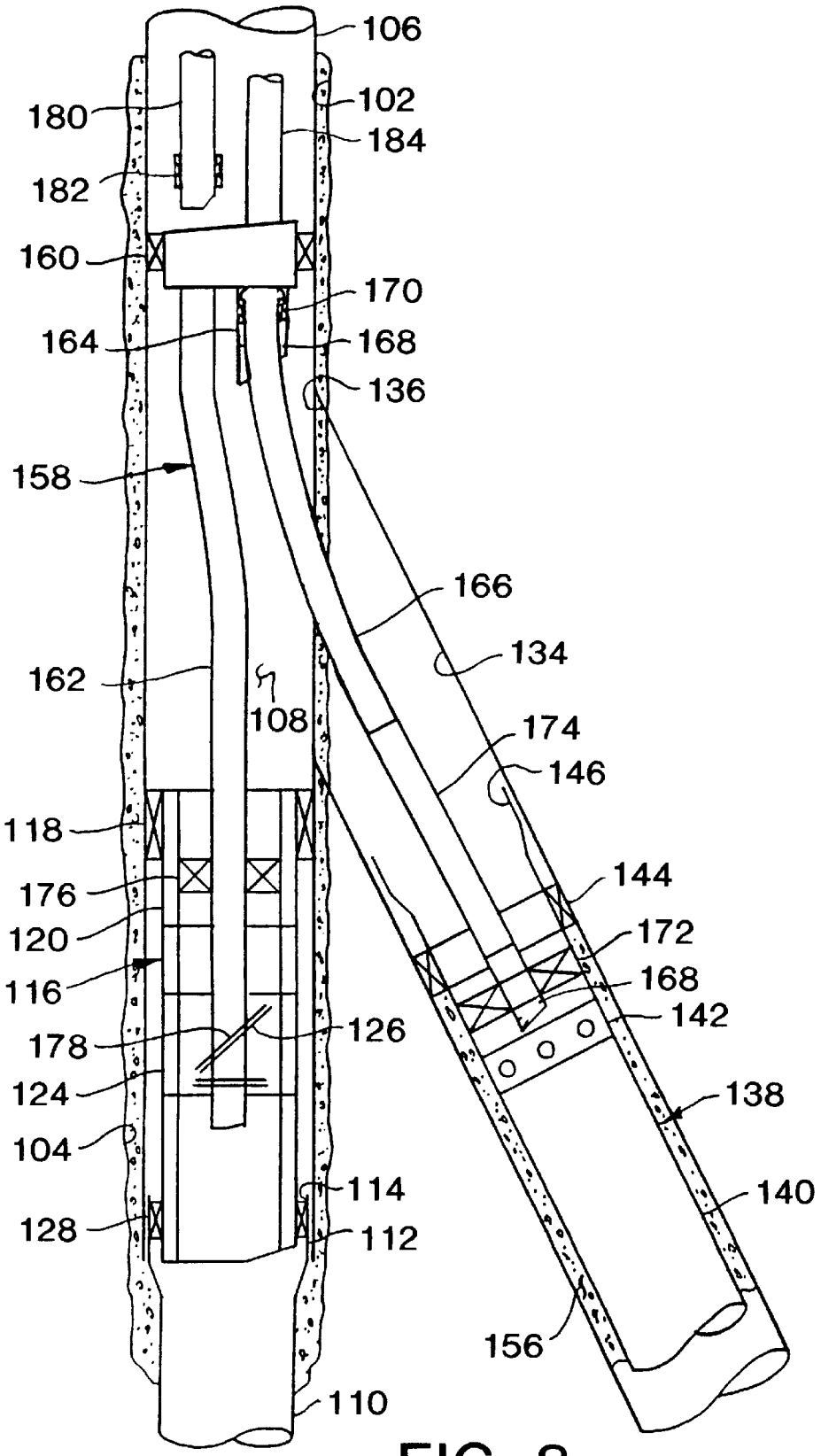

The tubular member 166 is then extended into the third weulbore portion 134, until the seal surface 172 may sealingly engage the seal surface 146 or, alternatively, if the seal surface 172 is a packer, until the seal surface or packer 172 may be set in the assembly 138 as shown in FIG. 8. At this point, the seal surface 170 sealingly engages the interior of the housing 164. To flow fluids from the interior of the liner 110 and, thus, the second wellbore portion 104, to the earth's surface, a tubing string 180 having a seal surface 182 may be lowered into the well and the seal surface 182 sealingly engaged with a bore of the packer 160 with which the tubing string 162 is in fluid communication.

Note that, with the seal surface 172 sealingly engaging the assembly 138, the seal surface 176 sealingly engaging the assembly 116, the seal surface 170 sealingly engaging the housing 164, and the packer 160 set in the casing 106, the junction 108 is isolated from fluid communication with the first wellbore portion 102 above the packer 160, the second welibore portion 104 below the assembly 116, and the third wellbore portion 134 below the assembly 138. Also note that the third wellbore portion 134 below the assembly 138 is in fluid communication with the interior of the tubular member 166 (and with the interior of a tubing string 184 connected thereto and extending to the earth's surface), and that the second wellbore portion 104 below the assembly 116 is in fluid communication with the interior of the tubing string 162 and with the interior of the tubing string 180. Commingling of fluids from the second and third wellbore portions 104, 134, if desired, may be accomplished by utilizing a single bore packer and wye block (see FIG. 3A and accompanying written description) in place of the multiple bore packer 160.

Figure 9:
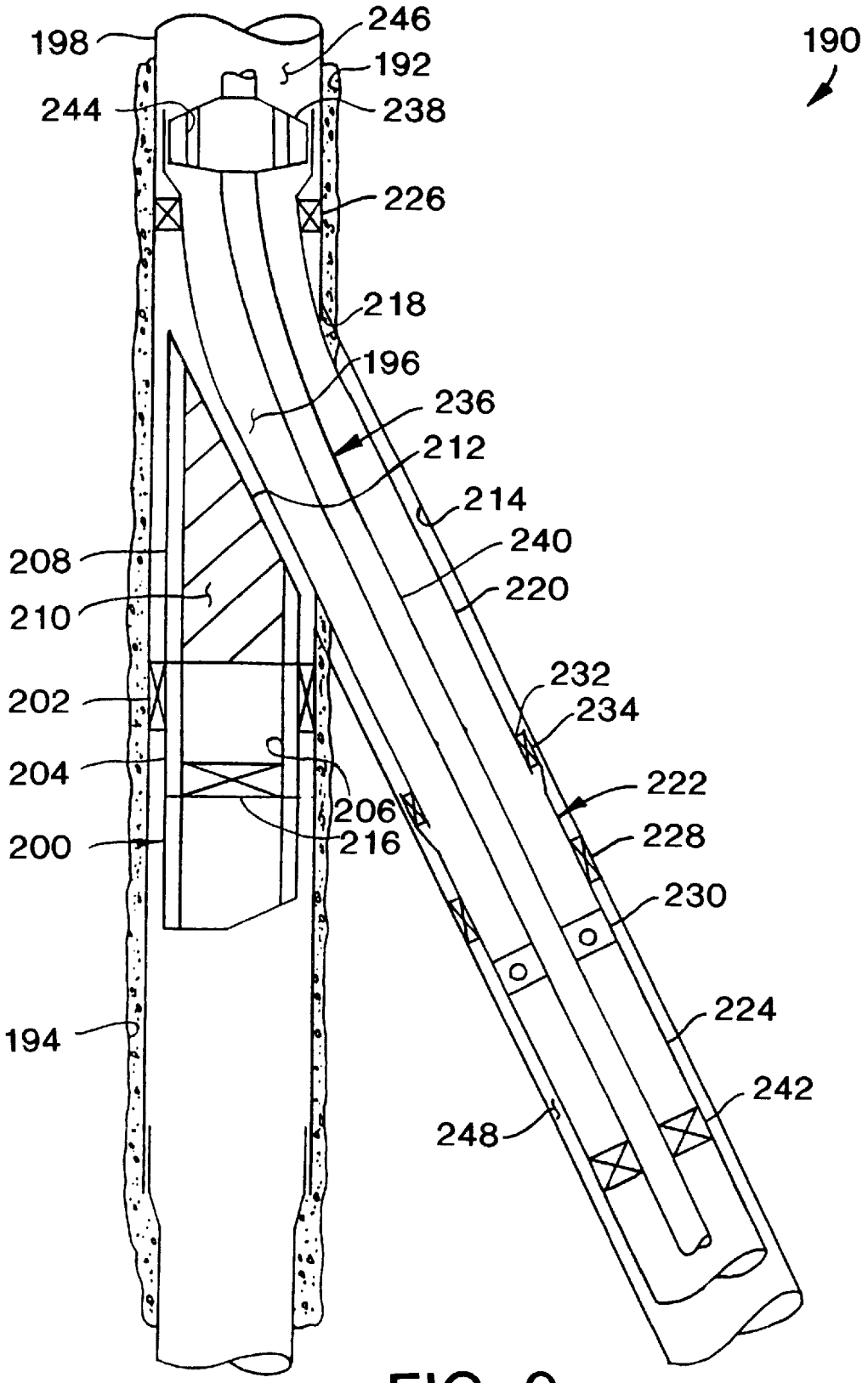
FIG. 9 is a schematic cross-sectional view of a subterranean well wherein an initial portion of a third method of completing the well has been performed, the method embodying principles of the present invention.

Referring additionally now to FIGS. 9–12, a method 190 of completing a subterranean well is representatively and schematically illustrated, the method embodying principles of the present invention. As shown in FIG. 9, some steps of the method 190 have been performed. A first wellbore portion 192 has been drilled from the earth's surface, and a second wellbore portion 194 has been drilled intersecting the first wellbore portion at an intersection or junction 196. A liner or casing 198 has been installed within the well, extending internally through the junction 196. The casing 198 is cemented within the first and second wellbore portions 192, 194.

An assembly 200 is then conveyed into the well. The assembly 200 includes a packer 202, a tubular structure 204 (which may be a separate tubular member, a mandrel of the packer, etc.) attached to the packer, a seal surface 206 (for example, a polished seal bore, a packing stack or other seal, a polished bore receptacle, etc.) attached to the tubular structure, a plug 216 preventing fluid flow through the tubular structure, and a whipstock 208 attached to the packer. As representatively illustrated, the whipstock 208 is of the type which has a relatively easily milled central portion 210 for ease of access to the interior of the assembly 200, but it is to be understood that the whipstock may be otherwise configured without departing from the principles of the present invention.

The assembly 200 is positioned within the well with the whipstock 208 being adjacent the junction 196. An inclined face 212 formed on the whipstock 208 faces radially toward a desired location for drilling a third wellbore portion 214. The packer 202 is set in the second wellbore portion 194, thus anchoring the assembly 200 within the well and sealingly engaging the second wellbore portion.

An opening 218 is then milled through the casing 198 by deflecting a cutting tool off of the whipstock inclined face 212. The third wellbore portion 214 is drilled extending outwardly from the opening 218. At this point, only an initial length of the third wellbore portion 214 is drilled, in order to minimize damage to the junction 196 area of the well. As will be more fully described hereinbelow, the third wellbore portion 214 is later extended further into the earth utilizing a removable tubular drilling guide 220.

An assembly 222 is then conveyed into the well. The assembly 222 includes a casing or liner 224, the tubular drilling guide 220, a packer 226 (for example, a retrievable packer or retrievable liner hanger capable of anchoring to and sealingly engaging the casing 198) attached to the drilling guide, a packer 228 (for example, an external casing packer) attached to the liner 224, a valve 230 (for example, a valve of the type used in staged cementing operations), a seal surface 232 (for example, a polished seal surface, a packing stack or other seal, etc.) attached to the drilling guide, and a seal surface 234 (for example, a polished bore receptacle, a seal, etc.) attached to the liner 224.

The assembly 222 may be conveyed into the well utilizing a running string 236. The running string 236 may include a running tool 238 capable of engaging the drilling guide 220, a tubing string 240 attached to the running tool, and a sealing device 242 (for example, a packer, packing stack or other seal, etc.). For convenience in later cementing operations, the running tool 238 may include ports 244 providing fluid communication between the interior of the assembly 222 above the sealing device 242 and an annulus 246 between the running string 236 and the first wellbore portion 192.

The assembly 222 is positioned in the well with the packer 228 being disposed within the third well portion 214. The drilling guide 220 extends internally through the junction 196, a portion thereof in the first wellbore portion 192, and a portion in the third wellbore portion 214. The packer 228 is set in the third wellbore portion 214 to thus anchor the assembly 222 and sealingly engage the third wellbore portion. The packer 226 is set in the first wellbore portion 192 to assist in anchoring the assembly 222 and to sealingly engage the first wellbore portion.

To cement the liner 224 in place, the sealing device 242 is sealingly engaged with the liner 224 and the valve 230 is opened. Cement or other cementatious material may then be flowed through the running string 236 and into an annulus 248 between the liner 224 and the third wellbore portion 214. Returns may be taken inward through the valve 230, through the interior of the assembly 222 above the sealing device 242, and through the ports 244 into the annulus 246.

Figure 10:
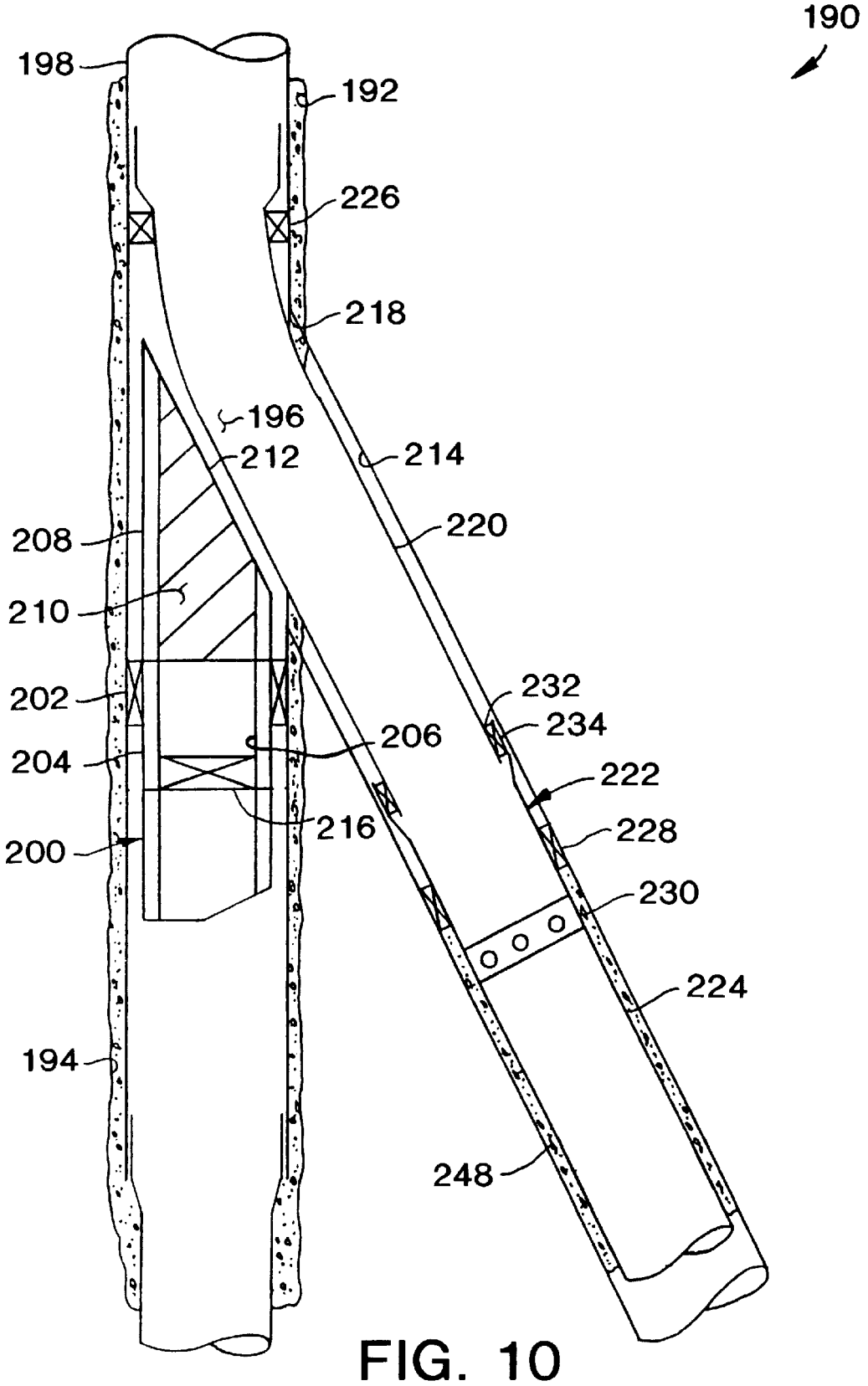
FIGS. 10 & 11 are schematic cross-sectional views of the well of FIG. 9, wherein further steps in the third method have been performed.

When the cementing operations have been completed, the running tool 238 is detached from the drilling guide 220 and the running string 236 is retrieved from the well. As shown in FIG. 10, the liner 224 has been cemented in place and the running string 236 has been removed. Note that the drilling guide 220 forms a smooth, generally continuous transition from the first wellbore portion 192 to the third wellbore portion 214, thus permitting drill bits, other cutting tools, and other equipment to pass from the first wellbore portion into the third wellbore portion without deflecting off of the whipstock 208 and without damaging any of the well surrounding the junction 196. Additionally, note that equipment may pass easily between the first and third wellbore portions 192, 214 through the drilling guide 220 without regard to the size or shape of the equipment, provided that the equipment will fit within the interior of the drilling guide.

The third wellbore portion 214 is then extended by drilling further into the earth, for example, to intersect a formation (not shown) from which it is desired to produce fluids. In order to extend the third wellbore portion 214, cutting tools are passed through the assembly 222 as described above. When the drilling operations are completed, the drilling guide 220 is detached from the liner 224 and retrieved from the well. To retrieve the drilling guide 220, a running tool, such as the running tool 238, is engaged with the drilling guide, the packer 226 is released from its engagement with the first wellbore portion 192, the seal surfaces 232, 234 are disengaged, and the drilling guide is raised to the earth's surface.

Figure 11:
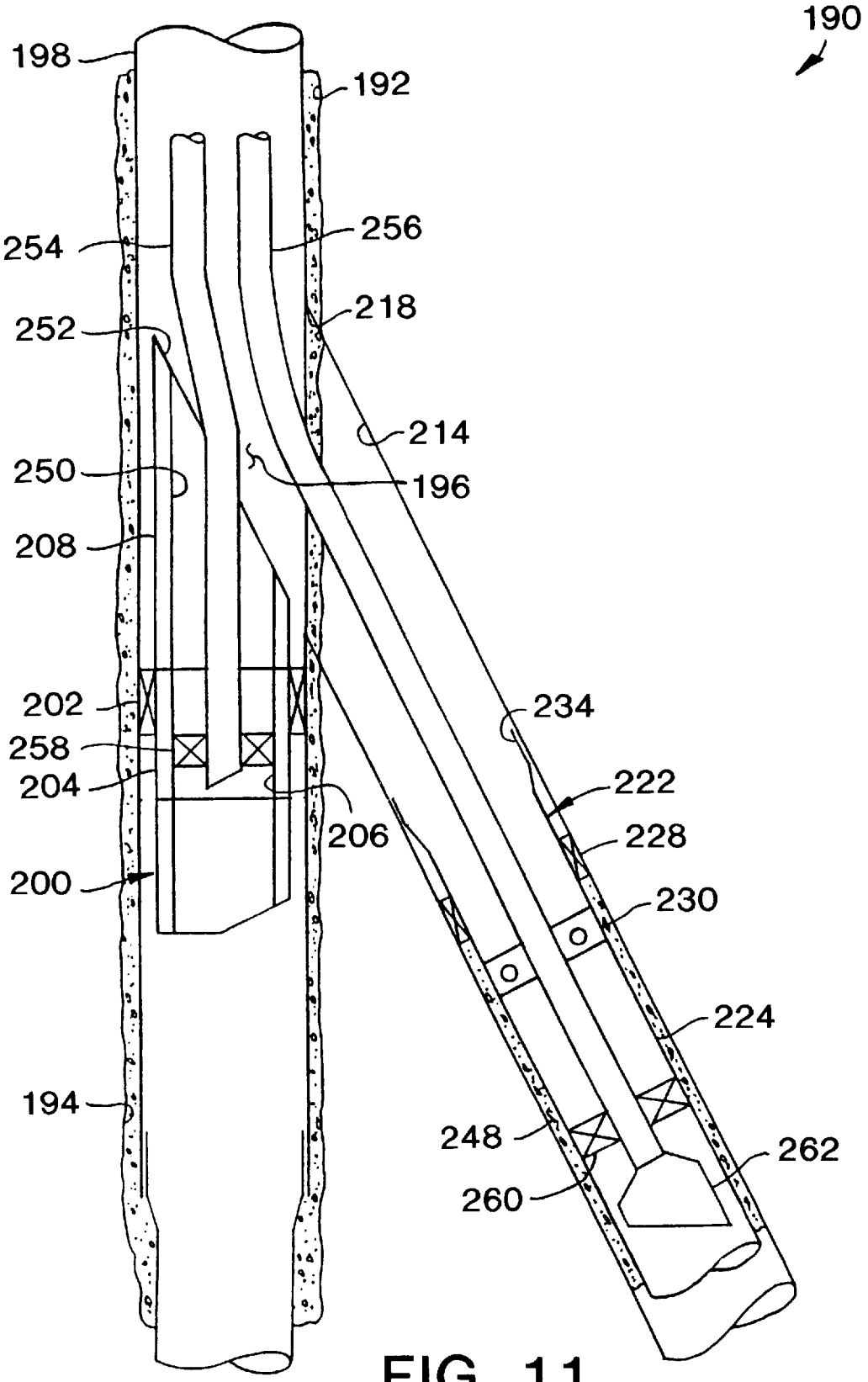

In an alternative method of retrieving the drilling guide 220, it may be severed from the remainder of the assembly 222 by, for example, mechanically or chemically cutting the drilling guide within the third wellbore portion 214. In that case, the drilling guide 220 may be an extension or a part of the liner 224 and may be sealingly coupled thereto by, for example, a threaded connection, etc., instead of utilizing the seal surfaces 232, 234 at a predetermined separation point. FIG. 11 shows the drilling guide 220 removed from the well.

An opening 250 is then created axially through the whipstock 208, removing the central portion 210, and leaving only a peripheral inclined surface 252 outwardly surrounding the opening 250. This removal can accomplished be by way of milling, mechanical removal, chemical removal, or by other methods that are well known in the art. In certain applications, the opening 250 may already be in the whipstock 208 at the time it is first positioned in the wellbore. The plug 216 is removed from the tubular structure 204, so that fluid flow is permitted through the assembly 200. At this point, the well of the method 190 is similar in many respects to the well of the method 10 representatively illustrated in FIG. 2. Tubing strings 254, 256 may be conveniently installed for conducting fluids from the second and third wellbore portions 194, 214 to the first wellbore portion 192, utilizing any of the methods described hereinabove. For example, the tubing string 254, including a seal or sealing device 258, and the tubing string 256, including a seal or sealing device 260 and a deflection member 262 near a lower end thereof, may be attached to a packer (such as the packer 74 or 96 shown in FIGS. 3A & 3B) and lowered simultaneously into the well.

With the tubing string 256 longer than the tubing string 254, the deflection member 262 first contacts the peripheral surface 252 and deflects the tubing string 256 to pass through the opening 218 (the deflection member not being permitted to pass through the opening 250) and into the third wellbore portion 214. As the tubing strings 254, 256 are further lowered, the tubing string 254 eventually passes through the whipstock opening 250. The sealing devices 258, 260 are then sealingly engaged with the tubular structure 204 and liner 224, respectively, and the packer attached the tubing strings is set in the first wellbore portion 192. Alternatively, one of the tubing strings 254, 256 may be installed in the well before the other one.

Figure 12:
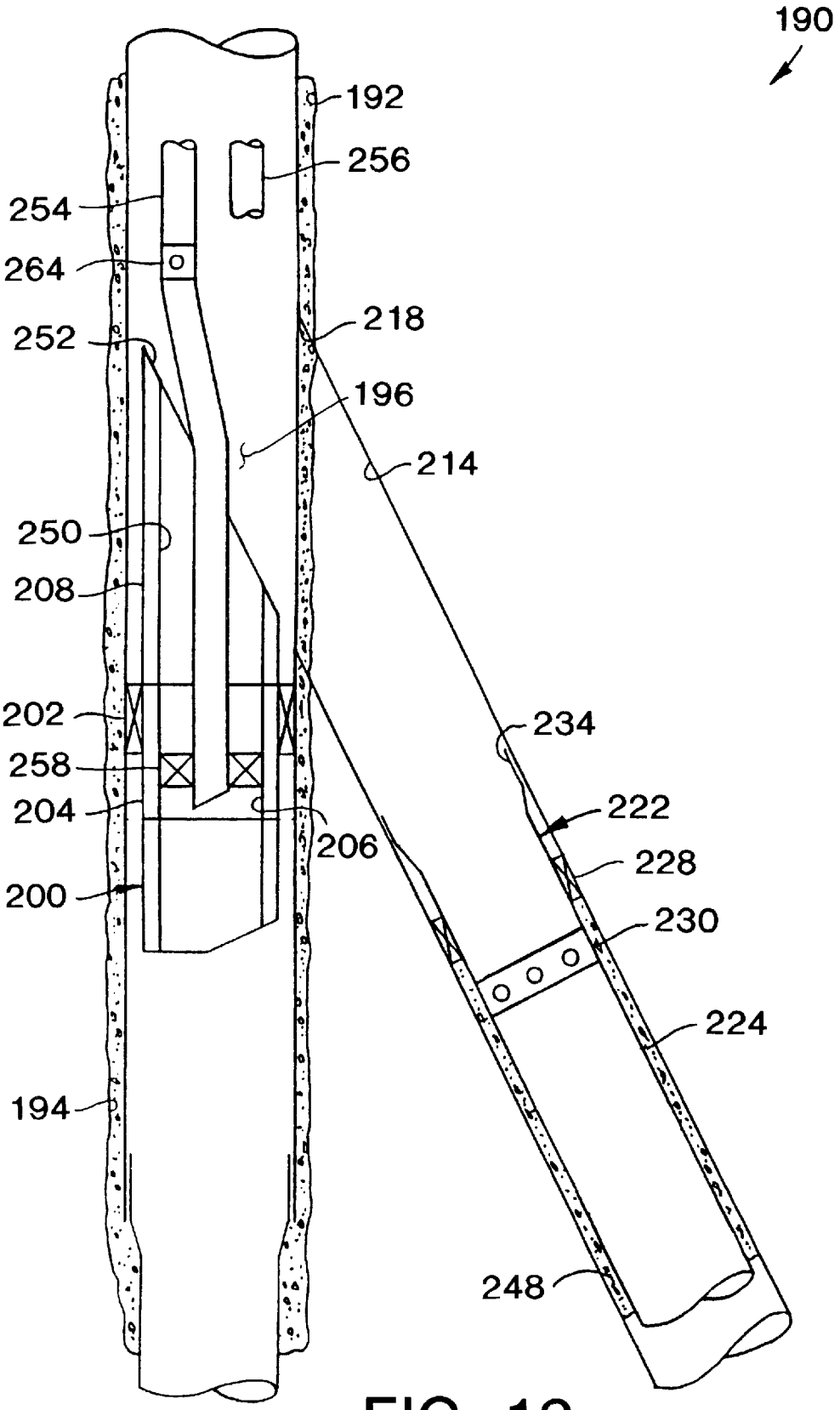
FIG. 12 is a schematic cross-sectional view of the well of FIG. 9, wherein alternate steps in the third method have been performed.

FIG. 12 representatively illustrates another alternative installation of the tubing strings 254, 256, wherein the tubing string 256 does not extend into the third wellbore portion 214. The tubing string 256 is shorter than the tubing string 254 and does not include the deflection member 262 or sealing device 260. For this reason, and if it is desired, the whipstock 208, instead of being milled through before installation of the tubing strings 254, 256, may be removed from the well after being detached from the packer 202. The whipstock 208 is shown in FIG. 12, since it may be desired in the future to install a tubing string or other equipment in the third wellbore portion 214.

Flow control devices, such as valves, plugs, etc., may be included in the tubing strings 254, 256, to permit selective fluid communication between the second and third wellbore portions 194, 214, and the first wellbore portion 192 through the tubing strings. For example, a valve 264, such as a DURASLEEVE® valve, may be installed in the tubing string 254, so that the tubing string 254 may be placed in fluid communication with the second wellbore portion 194 and with the third wellbore portion 214 when the valve is opened.

Note that the alternative installation of the tubing strings 254, 256 shown in FIG. 12 is substantially different from the installation of the tubing strings shown in FIG. 11 in the manner in which the area of the well surrounding the junction 196 is in fluid isolation or communication with the wellbore portions 192, 194, 214. In the installation shown in FIG. 11, it will be readily apparent that the area of the well surrounding the junction 196 is isolated from fluid communication with the third wellbore portion 214 below the sealing device 260, isolated from fluid communication with the second wellbore portion 194 below the sealing device 258, and isolated from fluid communication with the first wellbore portion 192 above the packer 76 or 94 (see FIGS. 3A & 3B). In contrast, in the installation shown in FIG. 12, it will be readily apparent that the area of the well surrounding the junction 196 is substantially isolated from fluid communication with the first and second wellbore portions 192, 194, but is in fluid communication with the third wellbore portion 214. Thus, the installation shown in FIG. 12 does not seal the junction 196 off from the third wellbore portion 214, and should be used where such lack of sealing is acceptable.

Figure 13:
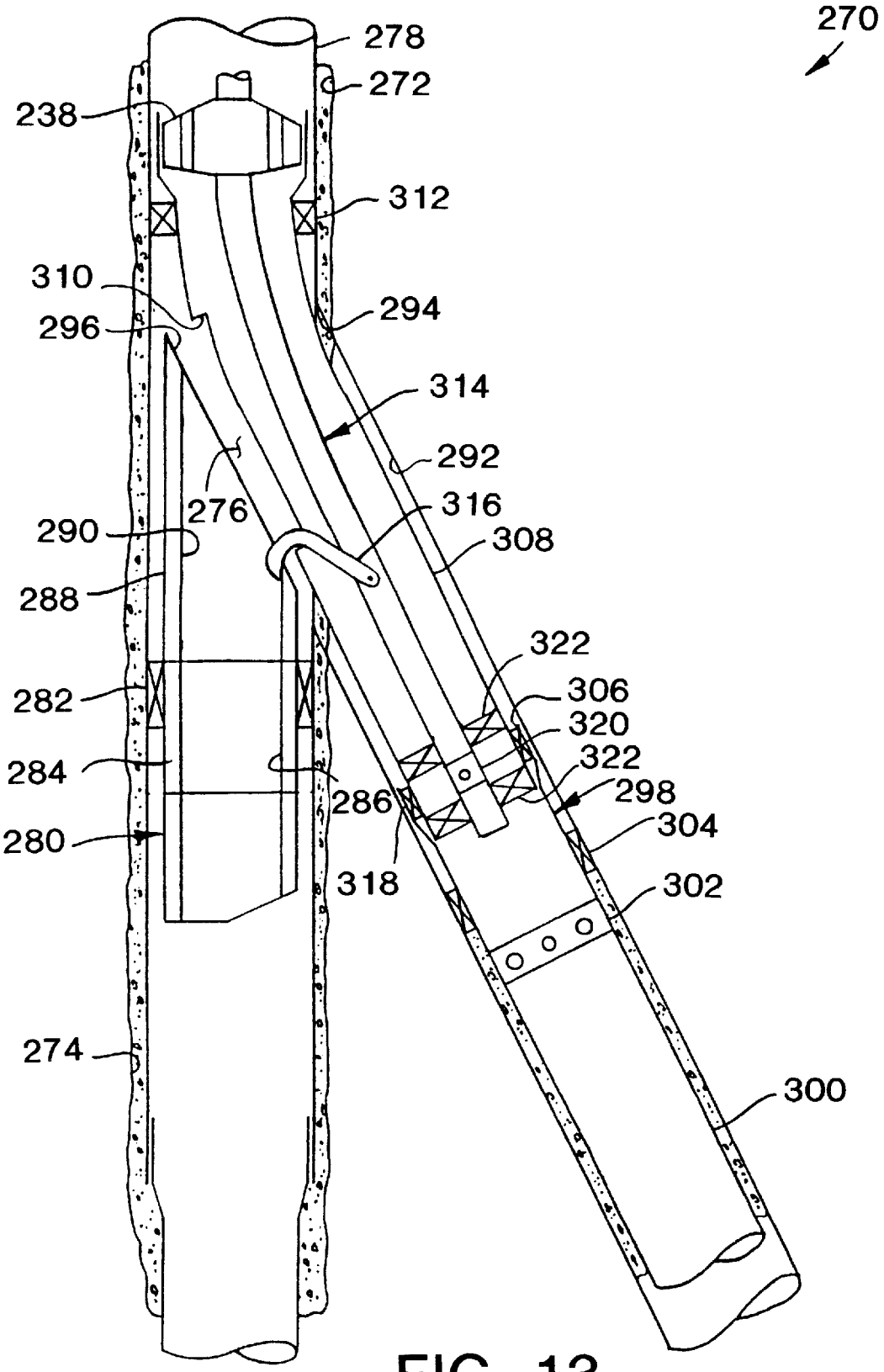
FIG. 13 is a schematic cross-sectional view of a subterranean well wherein an initial portion of a fourth method of completing the well has been performed, the method embodying principles of the present invention.
Figure 14:
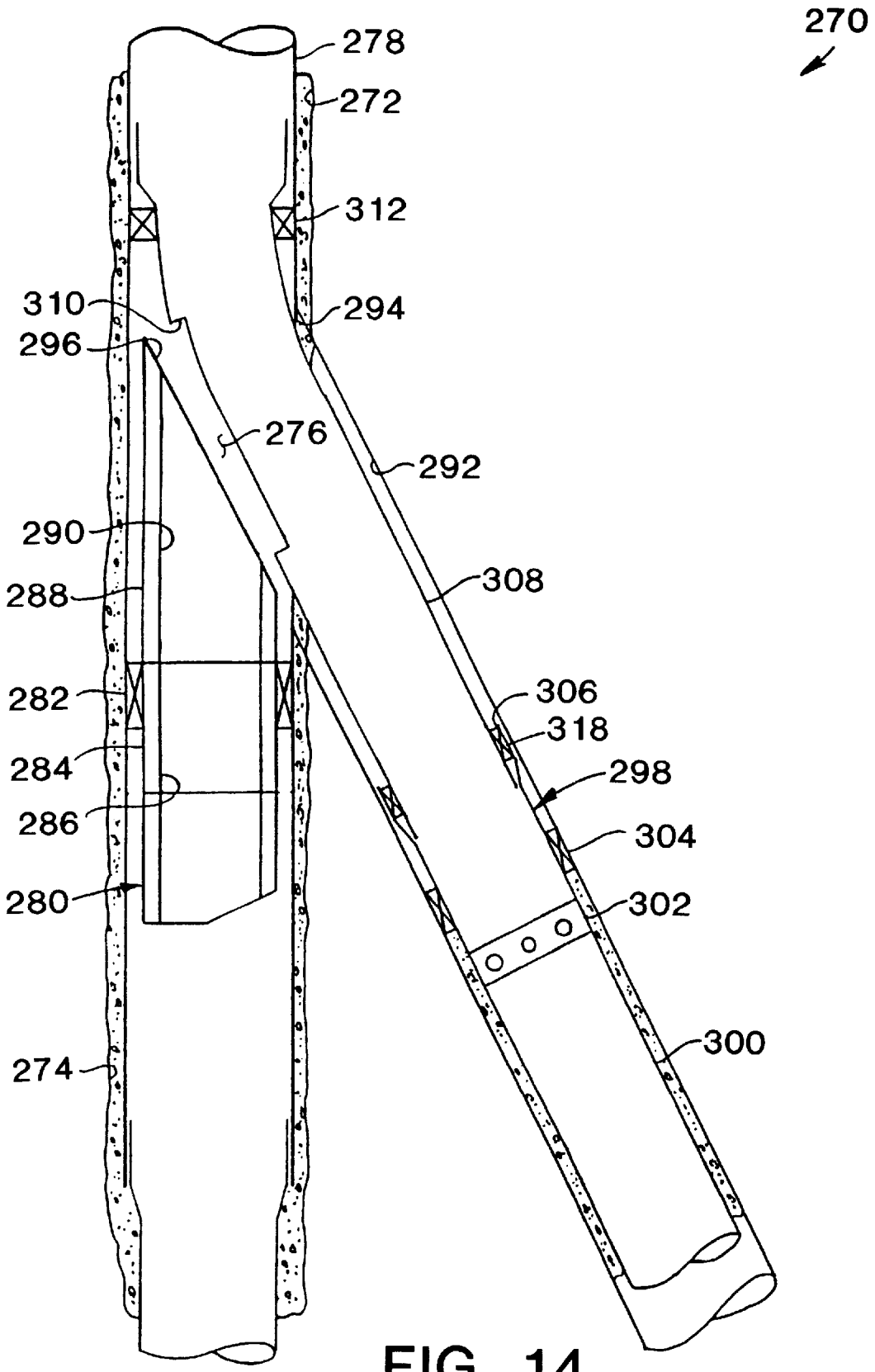
FIGS. 14 & 15 are a schematic cross-sectional views of the well of FIG. 13, wherein further steps in the fourth method have been performed.
Figure 15:
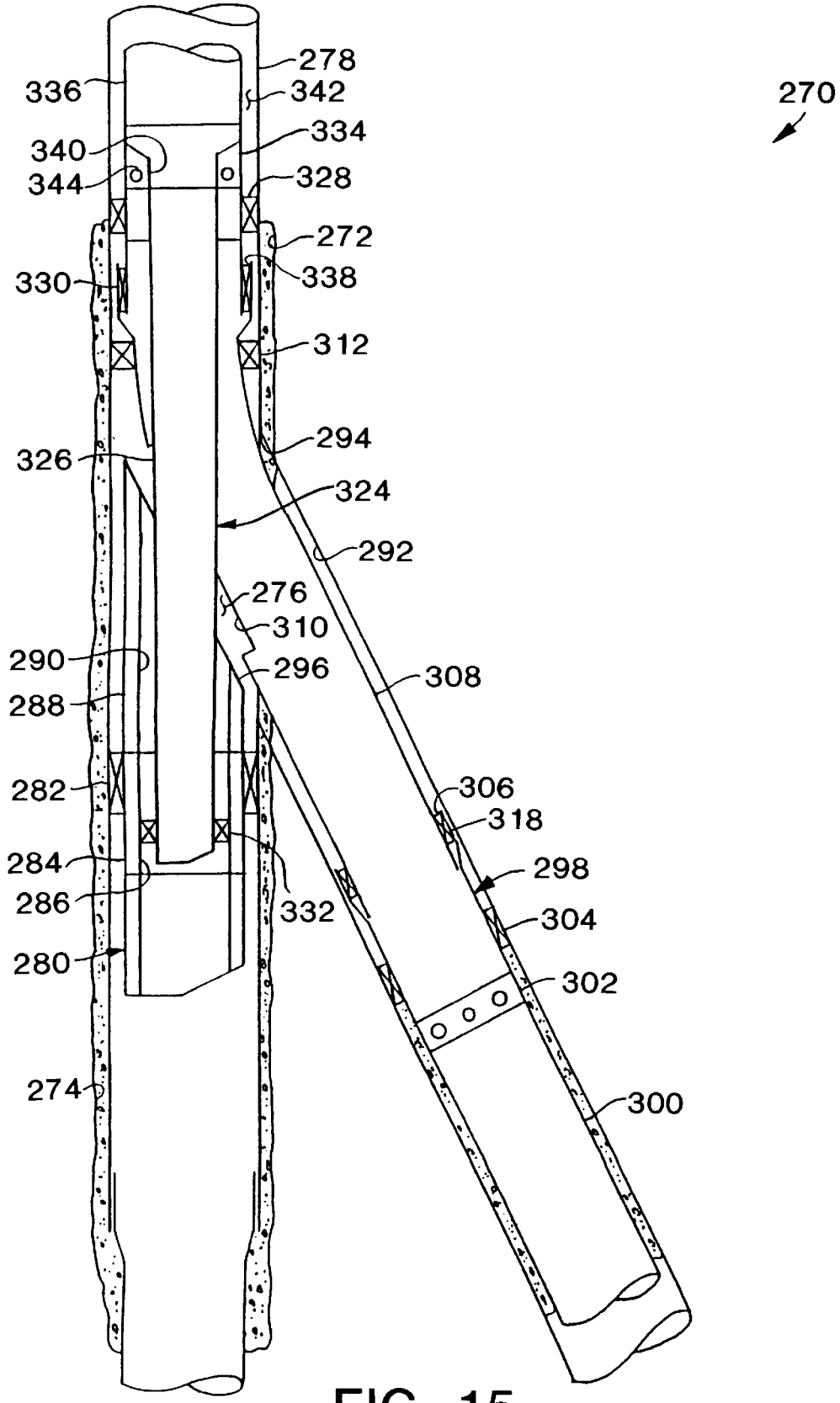

Referring additionally now to FIGS. 13–15, a method 270 of completing a subterranean well is representatively and schematically illustrated, the method embodying principles of the present invention. As shown in FIG. 13, some steps of the method 270 have already been performed. A first wellbore portion 272 has been drilled from the earth's surface, and a second wellbore portion 274 has been drilled intersecting the first wellbore portion at an intersection or junction 276. A liner or casing 278 has been installed within the well, extending internally through the junction 276. The casing 278 is cemented within the first and second wellbore portions 272, 274.

An assembly 280 is then conveyed into the well. The assembly 280 includes a packer 282, a tubular structure 284 (which may be a separate tubular member, a mandrel of the packer, etc.) attached to the packer, a seal surface 286 (for example, a polished seal bore, a packing stack or other seal, a polished bore receptacle, etc.) attached to the tubular structure, and a whipstock 288 attached to the packer. As representatively illustrated, the whipstock 288 is similar to the whipstock 208 described previously and has a relatively easily milled central portion for ease of access to the interior of the assembly 280, but it is to be understood that the whipstock may be otherwise configured without departing from the principles of the present invention. As shown in FIG. 13, the whipstock 288 central portion has been milled through, leaving an opening 290 therethrough.

The assembly 280 has been positioned within the well with the whipstock 288 being adjacent the junction 276. An inclined face formed on the whipstock 288 faced radially toward a desired location for drilling a third wellbore portion 292 before the whipstock was milled through. The packer 282 was set in the second wellbore portion 274, thus anchoring the assembly 280 within the well and sealingly engaging the second wellbore portion.

An opening 294 was then milled through the casing 278 by deflecting a cutting tool off of the whipstock inclined face. The third wellbore portion 292 was drilled extending outwardly from the opening 294. After drilling the third wellbore portion 292, the whipstock 288 was milled through, forming the opening 290 and leaving a peripheral inclined face 296 outwardly surrounding the opening 290.

An assembly 298 is then conveyed into the well. The assembly 298 includes a casing or liner 300, a valve 302 (for example, a valve of the type used in staged cementing operations), a packer 304 (for example, an external casing packer), a seal surface 306 (for example, a packing stack or other seal, a seal bore, a polished bore receptacle, etc.), a generally tubular member 308 having a window or aperture 310 formed through a sidewall portion thereof, and another packer 312 attached to the tubular member. The assembly 298 may be conveyed into the well suspended from a running string 314, similar to the running string 236 with running tool 238 previously described. In a unique aspect of the present invention, the running string 314 may also include a device 316 configured for locating the junction 276 so that the aperture 310 may be aligned with the opening 290, or with the second wellbore portion 274.

Note that the liner 300, valve 302, packer 304, and seal surface 306 may be separately conveyed into the well, similar to the manner in which the assembly 138 is conveyed and positioned in the method 100 using the running string 148. In that case, the running string 314 may convey the tubular member 308, packer 312, and a sealing device 318 (for example, an inflatable packer, a packing stack or other seal, etc.) into the well after the liner has been cemented into the third well portion 292 as previously described. The sealing device 318 may sealingly engage the seal surface 306, for example, if the sealing device is an inflatable packer, by opening a valve 320 positioned on the running string 314 between two sealing devices 322 straddling the sealing device 318, and applying fluid pressure to the running string to inflate the sealing device 318.

As representatively illustrated in FIG. 13, the locating device 316 is a hook-shaped member pivotably secured to the running string 314. The device 316 extends outward through the aperture 310 when the tubular member 308 is conveyed into the well. As the device 316 passes by the whipstock opening 290, the device is permitted to engage the whipstock 288 adjacent its peripheral surface 296, thereby aligning the aperture 310 with the opening 290. Of course, the device 316 may have many forms, and may be otherwise attached without departing from the principles of the present invention. For example, the device 316 may be attached to the tubular member 308 instead of the running string 314, the device may be shaped so that it cooperatively engages another portion of the whipstock 288 or another portion of the assembly 280, etc. Where the whipstock 288 is of the type releasably attached to the packer 282, the whipstock may be detached from the packer prior to installing the tubular member 308, in which case the opening 290 may not have been formed through the whipstock and the device 316 may engage the packer 282 instead of the whipstock. Also note that a seal (not shown in FIG. 13, see FIG. 20) may be positioned on the tubular member 308 circumscribing the aperture 310 and, when the device 316 has located the opening 290, the seal may sealingly engage the peripheral surface 296.

With the aperture 310 aligned with the opening 290, that is, facing toward the second wellbore portion 274, the packer 312 is set in the first wellbore portion 272. At this point, the tubular member 308 is sealingly engaged with the liner 300, and the tubular member extends through the junction 276. Of course, where the tubular member 308 is conveyed into the well separate from the liner 300, it may be preferable to sealingly engage the tubular member and liner before setting the packer 312. The packer 304 was set in the third wellbore portion 292 prior to cementing the liner 300 therein.

The running string 314 is then detached from the tubular member 308 and removed from the well. FIG. 14 shows the well after the running string 314 has been removed therefrom. At this point, an unobstructed path is presented from the first wellbore portion 272, through the interior of the assembly 286, and to the second wellbore portion 274. The junction 276 is in fluid communication with the first, second and third wellbore portions 272, 274, 292.

An assembly 324 is then conveyed into the well (see FIG. 15). The assembly 324 includes a tubular member 326, a packer 328, a sealing device 330 configured for sealing engagement with the tubular member 308, a sealing device 332 configured for sealing engagement with the seal surface 286, and a flow diverter device 334 attached to the packer 328. The assembly 324 is conveyed into the well utilizing a tubing string 336 extending to the earth's surface.

The assembly 324 is positioned within the well with the tubular member 326 extending through the aperture 310, the sealing device 332 sealingly engaging the seal surface 286, and the sealing device 330 sealingly engaging a seal surface 338 attached to the tubular member 308. The packer 328 is then set in the first wellbore portion 272 to anchor the assembly 324 in place.

At this point, the second wellbore portion 274 is in fluid communication with the interior of the tubing string 336, through the tubular member 326, and via a generally axially extending fluid passage 340 formed through the flow diverter 334. The third wellbore portion 292 below the liner 300 is in fluid commnunication with an annulus 342 between the tubing string 336 and the first wellbore portion 272, through the interior of the assembly 298, through the tubular member 308, and via a series of ports 344 formed generally radially through a sidewall portion of the flow diverter 334. In this manner, fluid from the third wellbore portion 292 may be produced via the annulus 342 to the earth's surface while fluid from the second wellbore portion 274 is produced via the interior of the tubing string 336 to the earth's surface. Alternatively, fluid may be injected from the earth's surface via the annulus 342 or the tubing string 336, while fluid is produced via the other. In that case, preferably the fluid to be injected is flowed from the earth's surface via the annulus 342.

Figure 16:
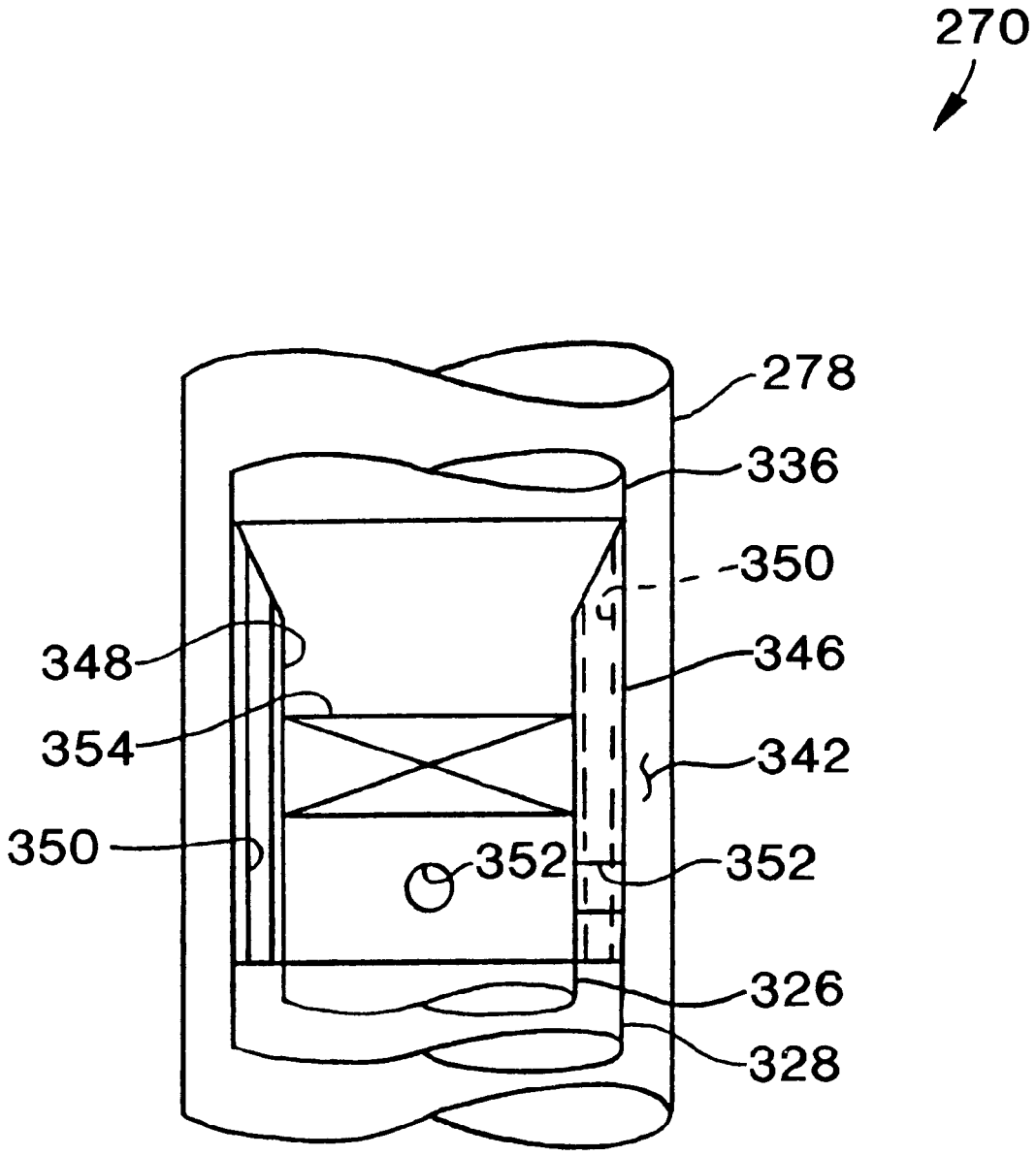
FIG. 16 is a schematic cross-sectional view of an apparatus which may be utilized in the fourth method, the apparatus embodying principles of the present invention.

Referring additionally now to FIG. 16, an alternate flow diverter 346 is representatively and schematically illustrated, the flow diverter embodying principles of the present invention. The flow diverter 346 may be used in place of the flow diverter 334 shown in FIG. 15.

The flow diverter 346 includes a centrally disposed axial flow passage 348, a series of peripherally disposed, circumferentially spaced apart, and axially extending fluid passages 350, and a series of circumferentially spaced apart and generally radially extending ports 352. A retrievable plug 354 initially prevents fluid flow axially through the central flow passage 348.

When installed in place of the flow diverter 334 in the method 270, the peripheral fluid passages 350 permit fluid communication between the interior of the tubular member 308 (and, thus, with the third wellbore portion 292) and the interior of the tubing string 336. The radial ports 352 permit fluid communication between the interior of the tubular member 326 (and, thus, with the second wellbore portion 274) and the annulus 342. If it is desired to commingle these flows, or otherwise to provide fluid communication between the fluid passages 350 and the radial ports 352, the plug 354 may be removed from the axial flow passage 348. This may, for example, be desired to provide circulation between the annulus 342 and the tubing string 336, for example, to kill the well, etc. The plug 354 may later be replaced in the axial flow passage 348, if desired. Another reason for removing the plug 354 may be to provide unrestricted access to the second wellbore portion 274 through the tubular member 326, for example, for remedial operations therein.

If it is desired to remove the plug 354 without permitting fluid communication between the flow passages 350 and the radial ports 352, another flow diverter 356 (see FIG. 19) embodying principles of the present invention may be used in place of the flow diverter 346. The flow diverter 356 includes an internal sleeve 358 and circumferential seals 360 axially straddling its radial ports 362 (only one of which is visible in FIG. 19). When its plug 364 is removed from its central axial flow passage 366, the sleeve 358 may be displaced so that the sleeve blocks fluid communication between the central flow passage and the radial ports 362. The sleeve 358 may be so displaced, for example, by utilizing a conventional shifting tool, or the sleeve may be releasably attached to the plug 364, so that, as the plug is removed from the central flow passage 366, the sleeve is displaced therewith, until the sleeve blocks flow through the radial ports 362, at which time the plug is released from the sleeve.

Figure 17A:
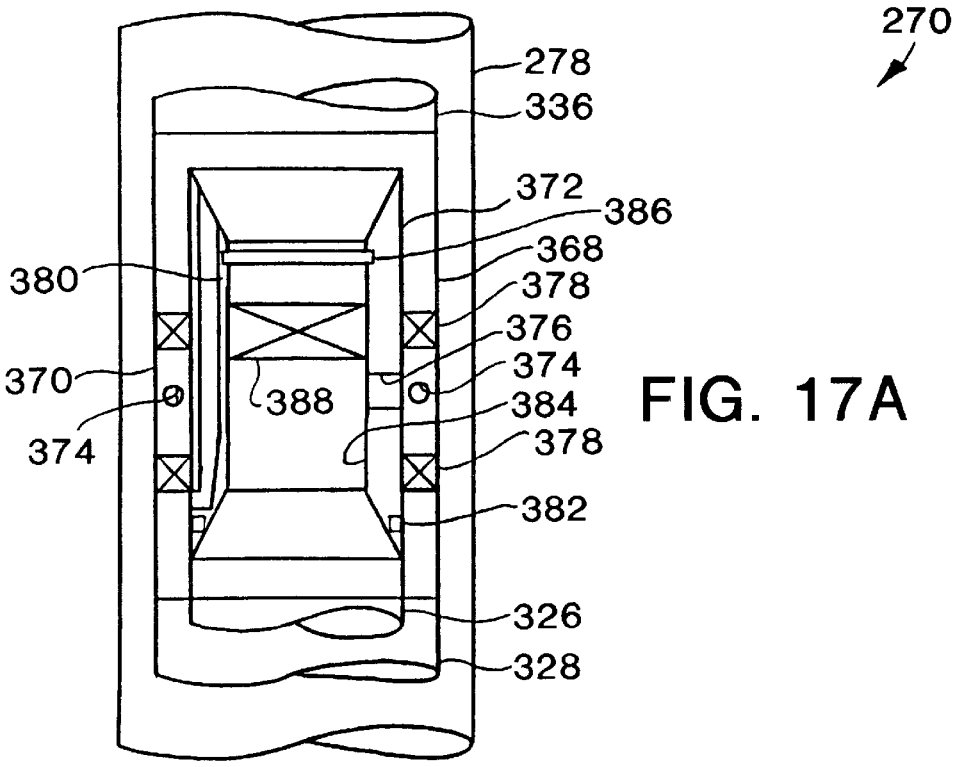
FIGS. 17A & 17B are schematic cross-sectional views of alternate configurations of an apparatus which may be utilized in the fourth method, the apparatus embodying principles of the present invention.
Figure 17B:
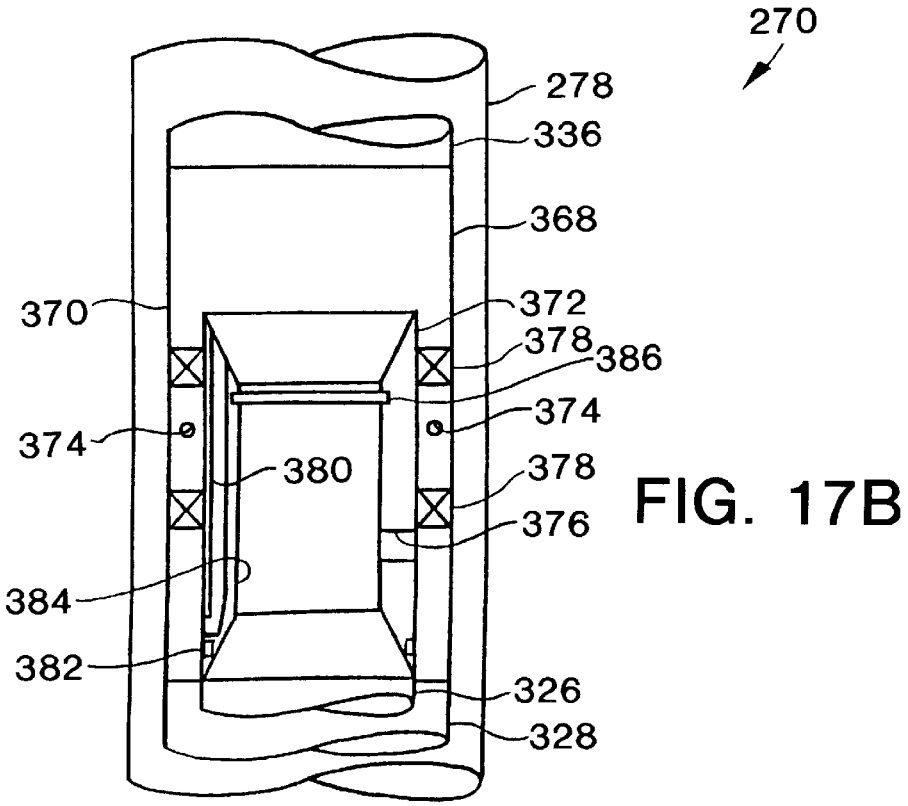

Referring additionally now to FIGS. 17A & 17B, another flow diverter 368 is representatively and schematically illustrated, the flow diverter embodying principles of the present invention. As with the flow diverter 346, the flow diverter 368 shown in FIGS. 17A & 17B may be utilized in place of the flow diverter 334 in the method 270. The flow diverter 368 includes an outer housing 370 and a generally tubular sleeve 372 axially slidingly disposed within the housing.

The housing 370 includes a series of circumferentially spaced apart and generally radially extending ports 374 providing fluid communication through a sidewall portion of the housing. Fluid flow through the ports 374 is selectively permitted or prevented, depending upon the position of the sleeve 372 within the housing 370. As shown in FIG. 17A, fluid flow is permitted through the ports 374, due to a generally radially extending port 376 formed through the sleeve 372 being in fluid communication therewith. Such fluid communication is permitted since both the housing ports 374 and the sleeve port 376 are axially straddled by two seals 378 which sealingly engage the exterior of the sleeve 372 and the interior of the housing 370. As shown in FIG. 17B, fluid flow is prevented through the ports 374, the sleeve 372 having been axially displaced so that the port 376 is no longer straddled by the seals 378.

The sleeve 372 further includes a generally axially extending flow passage 380. The flow passage 380 permits fluid communication between the interior of the tubing string 336 and the interior of the tubular member 308 (and, thus, with the third wellbore portion 292). A circumferential seal 382 isolates the flow passage 380 from fluid communication with an axially extending central flow passage 384 formed through the sleeve 372. A conventional latching profile 386 is formed internally on the sleeve 372 and permits displacement of the sleeve 372 by, for example, latching a shifting tool thereto.

A plug 388 may be initially installed in the central flow passage 384 to prevent fluid flow therethrough. Note that the sleeve 372 in the flow diverter 368 may be displaced without removing the plug 388, since the shifting profile 386 is positioned above the plug 388. Removal of the plug 388 permits fluid communication between the interior of the tubular member 326 (and, thus, the second wellbore portion 274) and the interior of the tubing string 336.

Figure 18:
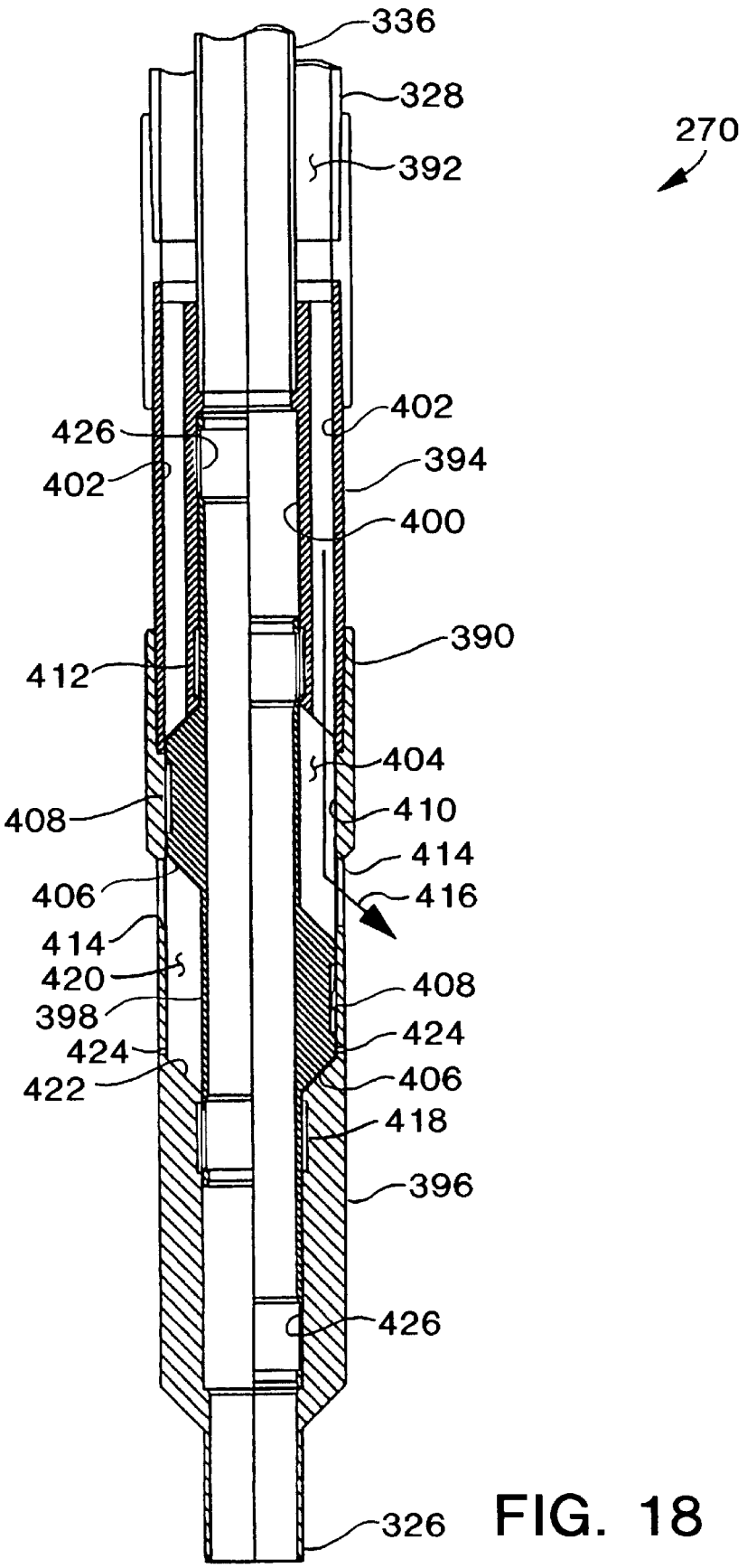
FIG. 18 is a cross-sectional view of an apparatus which may be utilized in the fourth method, the apparatus embodying principles of the present invention.

Referring additionally now to FIG. 18, a flow. diverter 390 embodying principles of the present invention is representatively and schematically illustrated. The flow diverter 390 may be utilized in the method 270 in place of the flow diverter 334. As representatively illustrated, the flow diverter 390 may be positioned in the assembly 324 between the packer 328 and the tubular member 326. In this manner, the annulus 342 is in fluid communication with an annulus 392 between the tubing string 336 and the interior of the packer 328.

The flow diverter 390 includes a generally tubular upper housing 394 coaxially attached to a generally tubular lower housing 396. In the method 270, the upper housing 394 is attached to the packer 328 and to the tubing string 336, and the lower housing is attached to the tubular member 326. A generally tubular sleeve 398 is axially reciprocably disposed within the upper and lower housings 394, 396.

The upper housing 394 includes a central axially extending flow passage 400 formed therethrough, within which the sleeve 398 is slidingly disposed. A series of circumferentially spaced apart and axially extending peripheral flow passages 402 are formed through the upper housing 394. The flow passages 402 permit fluid communication between the annulus 392 and an annulus 404 radially between the lower housing 396 and the sleeve 398 and axially between the upper housing 394 and a radially enlarged portion 406 formed on the sleeve. The central flow passage 400 permits fluid communication between the interior of the tubing string 336 and the interior of the tubular member 326 (and, thus, the second well portion 274). Of course, a plug may be disposed within the upper housing 394, lower housing 396, or sleeve 398 if desired to prevent such fluid communication.

FIG. 18 shows the sleeve 398 in alternate positions. With the sleeve 398 in an upwardly displaced position, a seal 408 carried on the radially enlarged portion 406 sealingly engages a seal bore 410 formed internally on the lower housing 396. Another seal 412 carried internally on the upper housing 394 sealingly engages the exterior of the sleeve 398. Thus, with the sleeve 398 in its upwardly disposed position, fluid flow is prevented through the flow passages 402.

With the sleeve 398 in its downwardly displaced position, the seal 408 no longer sealingly engages the bore 410, and fluid communication is permitted between the flow passages 402 and a series of ports 414 formed radially through the lower housing 396. Thus, fluid (indicated by arrow 416) may be flowed from the annulus 392 through the ports 414 and into the interior of the tubular member 308 (and, thus, into the third wellbore portion 292) when the sleeve 398 is in its downwardly disposed position.

A seal 418 carried internally within the lower housing 396 sealingly engages the exterior of the sleeve 398. An annulus 420 radially between the sleeve 398 and the interior of the lower housing 396 and axially between the enlarged portion 406 and a shoulder 422 formed internally on the lower housing 396 is in fluid communication with the exterior of the flow diverter 390 via the ports 414 (when the sleeve is in its upwardly displaced position) and a series of ports 424 formed radially through the lower housing 396 (at all times). When the fluid pressure in the annulus 404 exceeds the fluid pressure in the annulus 420, the sleeve 398 is biased downwardly. Thus, the flow diverter 390 may be installed in the assembly 324 and conveyed into the well with the sleeve 398 in its upwardly disposed position, and then, after the assembly has been installed as previously described in the method 270, fluid pressure may be applied to the annulus 342 at the earth's surface, thereby biasing the sleeve 398 to displace downwardly and permit fluid communication between the annulus 392 and the ports 414. The sleeve 398 also has latching profiles 426 formed internally thereon to permit displacement of the sleeve by, for example, latching a shifting tool therein in a conventional manner.

Figure 19:
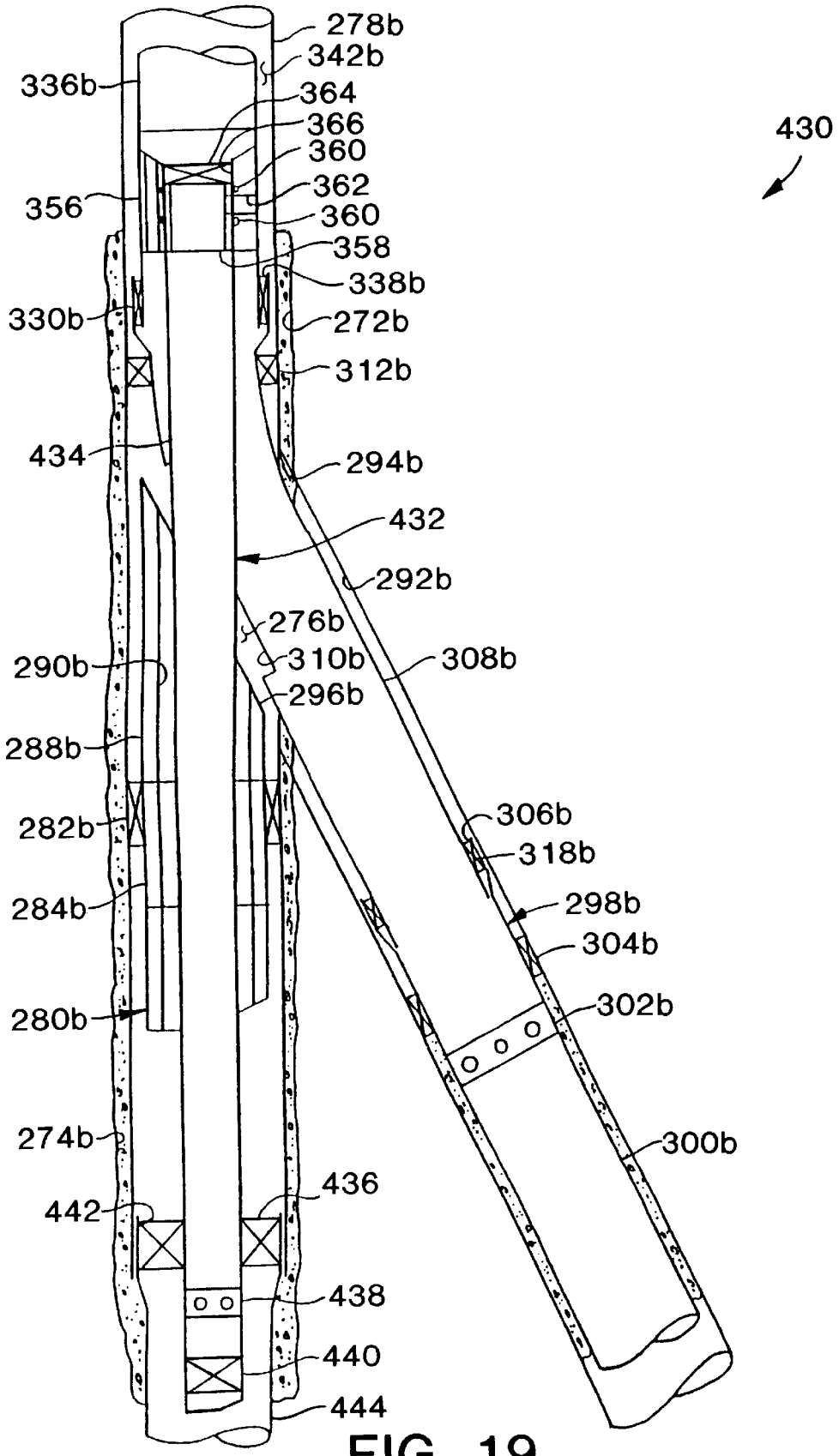
FIG. 19 is a schematic cross-sectional view of a fifth method of completing a subterranean well, wherein steps of the method have been performed, the method embodying principles of the present invention.

Referring additionally now to FIG. 19, a method 430 of completing a subterranean well embodying principles of the present invention is representatively and schematically illustrated. The method 430 is somewhat similar to the method 270 and, therefore, elements shown in FIG. 19 which are similar to those previously described are indicated using the same reference numerals, with an added suffix "b". In the method 430, after the assembly 298*b*, including the tubular member 308*b*, is installed in the well as previously described, an assembly 432 is conveyed into the well instead of the assembly 324 in the method 270.

The assembly 432 includes a tubular member 434, the flow diverter 356, the sealing device 330*b*, a sealing device 436 (for example, a packing stack,. packer, a seal, a polished seal surface, etc.), a valve 438 (for example, a DURASLEEVE® valve), and a plug 440. The assembly 432 is conveyed into the well suspended from the tubing string 336*b*. The sealing device 330*b* sealingly engages the seal surface 338*b*, and the sealing device 436 sealingly engages a seal surface 442 (for example, a polished seal bore, a packing stack or other seal, etc.) attached to a casing or liner 444 previously installed in the second well portion 274*b*. The valve 438 may then be utilized to selectively permit or prevent fluid flow between the second wellbore portion 274*b* and the interior of the tubular member 434, and the plug 440 may be removed to permit unrestricted access to the second wellbore portion (provided, of course, that the plug 364 of the flow diverter 356 has also been removed).

It is to be understood that others of the flow diverters 334, 390, 368, 346 may be utilized in place of the flow diverter 356 in the method 430 without departing from the principles of the present invention. Note that the method 430 does not utilize the packer 328 of the method 270, but that the method 430 may utilize the packer 328 without departing from the principles of the present invention. Preferably, an anchoring device is provided with the assembly 432 to secure it in its position in the well as shown in FIG. 19, and for that purpose, the sealing device 436 may be a packer if the packer 328 is not utilized.

Figure 20:
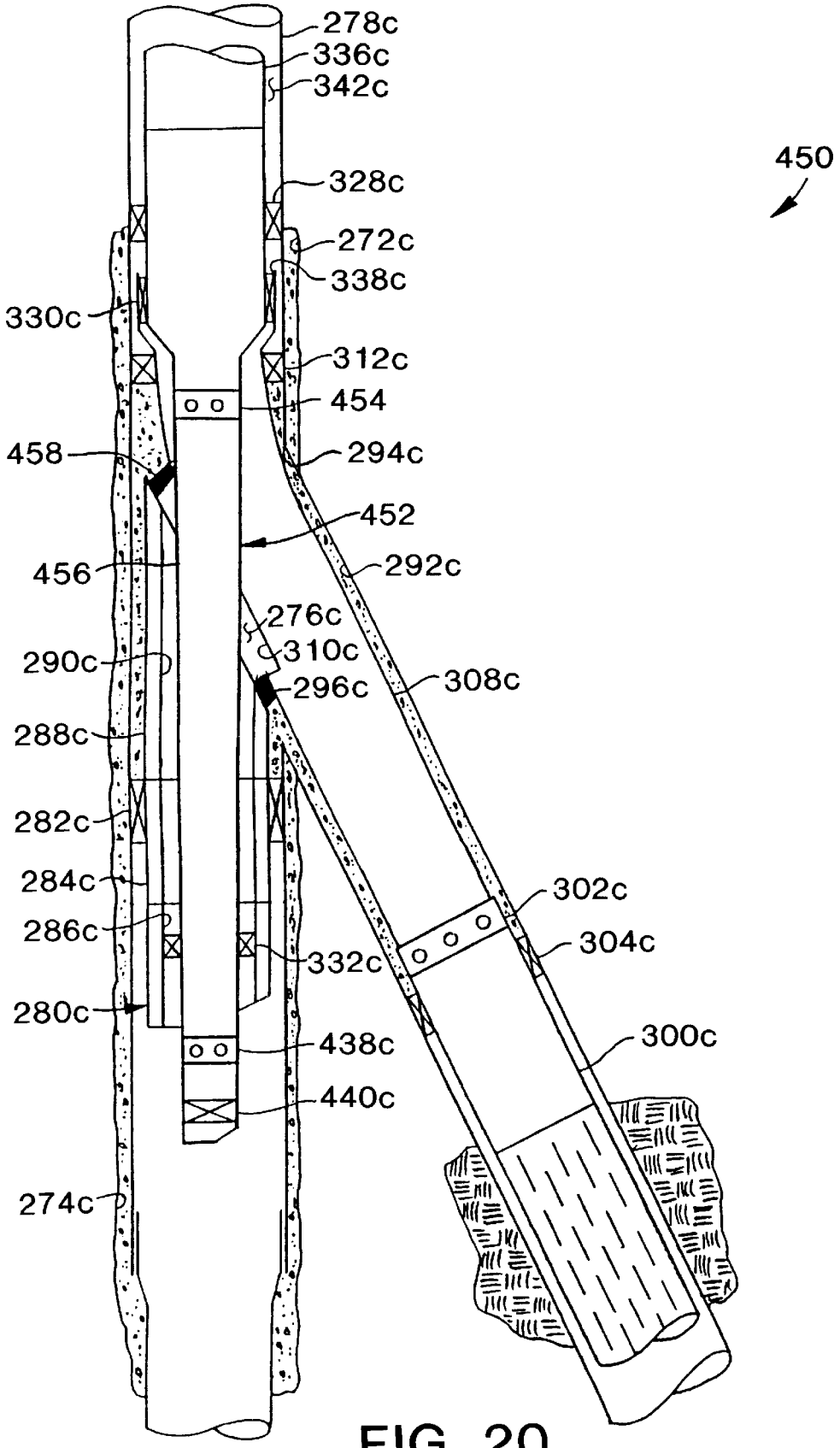
FIG. 20 is a schematic cross-sectional view of a sixth method of completing a subterranean well, wherein steps of the method have been performed, the method embodying principles of the present invention.

Referring additionally now to FIG. 20, a method 450 of completing a subterranean well embodying principles of the present invention is representatively and schematically illustrated. The method 450 is somewhat similar to the method 270 and, therefore, elements shown in FIG. 20 which are similar to those previously described are indicated using the same reference numerals, with an added suffix "c". In the method 450, after the assembly 298*c*, including the tubular member 308*c*, is installed in the well as previously described, an assembly 452 is conveyed into the well instead of the assembly 324 in the method 270.

In addition, the liner 300*c*, packer 304*c*, valve 302*c*, and tubular member 308*c* are arranged somewhat differently in the third wellbore portion 292*c* in the method 450. Instead of the liner 300*c* being cemented within the welibore portion 292*c* below the packer 302*c*, the tubular member 308*c* is cemented within the first and third welibore portions 272*c*, 292*c*, with the cement or other cementations material extending generally between the packers 312*c* and 304*c*. In this manner, the area of the well surrounding the junction 276*c* is isolated from fluid communication with the first, second and third wellbore portions 272*c*, 274*c*, 292*c*. The cementatious material may also surround the whipstock 288*c* in the second wellbore portion 274*c*. In order to prevent the cementations material from entering the interior of the tubular member 308*c* and the whipstock opening 290*c*, a seal 458 may be provided for sealing engagement with the peripheral surface 296*c* and with the tubular member 308*c* circumscribing the aperture 310*c*. The seal 458 may be carried on the peripheral surface 296*c*, or it may be carried on the tubular member 308*c*. Alternatively, the cementatious material may be permitted to flow into the opening 290*c* and aperture 310*c*, and then later removed before installing the assembly 452.

The assembly 452 includes the packer 328*c*, the sealing device 330*c*, a valve 454 (for example, a DURASLEEVE® valve), a tubular member 456, the sealing device 332*c*, the valve 438*c*, and the plug 440*c*. After the tubular member 308*c* has been installed as previously described, the assembly is conveyed into the well suspended from the tubing string 336*c*. The sealing device 330*c* sealingly engages the seal surface 338*c*, and the sealing device 332*c* sealingly engages the seal surface 286*c*. The packer 328*c* is then set to secure the assembly 452 within the well.

Utilizing the valves 454, 438*c*, and the plug 440*c*, fluid communication between the interior of the tubing string 336*c* and each of the second and third wellbore portions 274*c*, 292*c* may be conveniently and independently controlled. Fluid communication between the interior of the tubing string 336*c* and the second wellbore portion 274*c* may be established by opening the valve 438*c* and/or by removing the plug 440*c*. Fluid communication between the interior of the tubing string 336*c* and the third wellbore portion 292*c* may be established by opening the valve 454. Of course, both valves 454, 438*c* may be opened, or the valve 454 may be opened and the plug 440*c* removed, to thereby permit fluid communication between the second and third wellbore portions 274*c*, 292*c* and the interior of the tubing string 336*c* at the same time.

Figure 21:
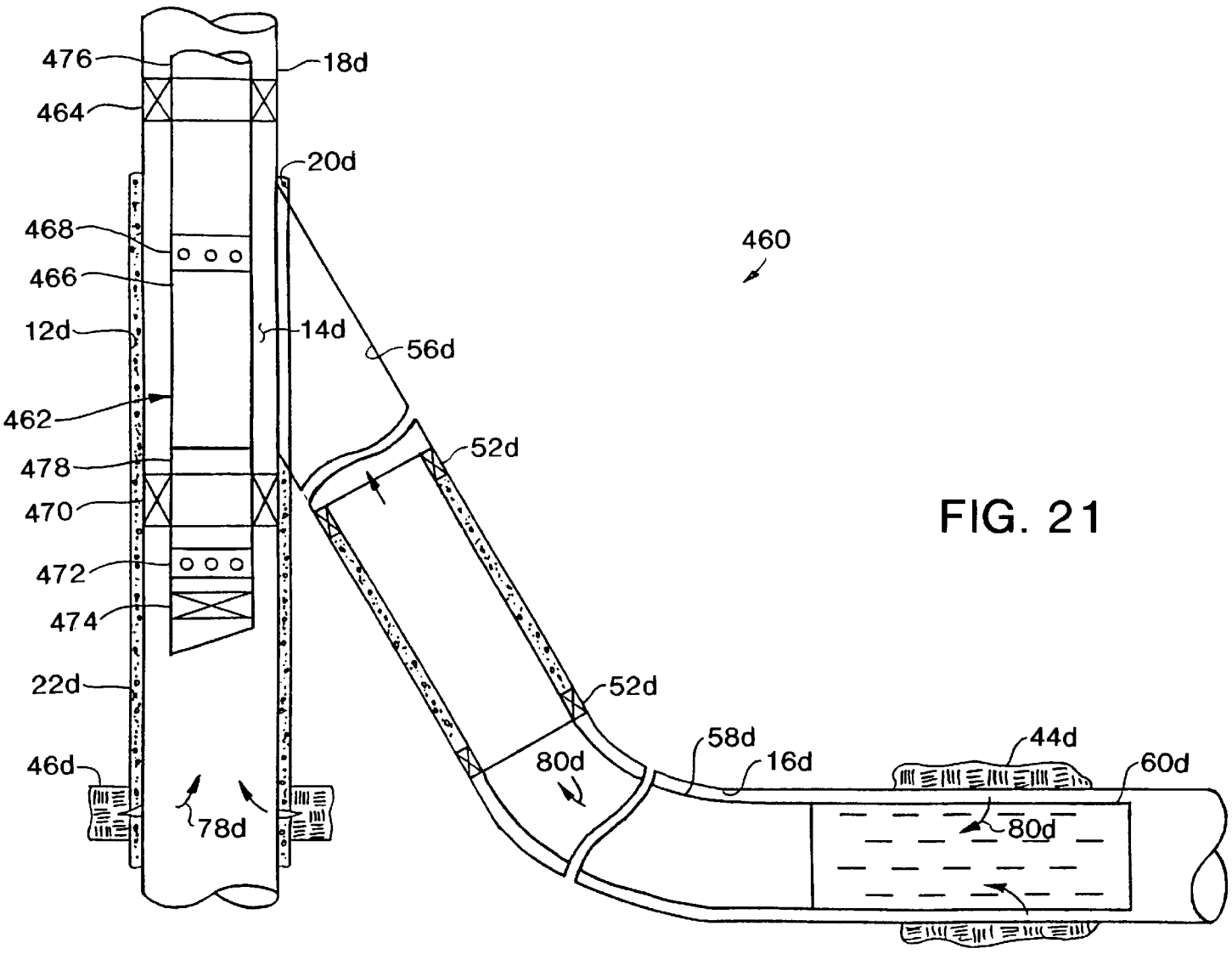
FIG. 21 is a schematic cross-sectional view of a seventh method of completing a subterranean well, wherein steps of the method have been performed, the method embodying principles of the present invention.

Referring additionally now to FIG. 21, a method 460 of completing a subterranean well embodying principles of the present invention is representatively and schematically illustrated. The method 460 is in some respects similar to the method 10 as representatively illustrated in FIG. 2, and, therefore, elements shown in FIG. 21 which are similar to those previously described are indicated in FIG. 21 using the same reference numerals, with an added suffix "d".

After the parent wellbore 12*d* and lateral wellbore 16*d* have been drilled, the casing 18*d* installed, and the tubular string 58*d* installed in the lateral wellbore (and the whipstock 66, packer 28, etc., removed from the lower parent wellbore 22*d*), an assembly 462 is conveyed into the well. The assembly 462 includes a packer 464 a tubular string 466 attached to the packer, a valve 468 (for example, a DURASLEEVE® valve), another packer 470, another valve 472 (for example, a DURASLEEVE® valve), and a plug 474. The assembly 462 may be conveyed into the well suspended from a tubing string 476 extending to the earth's surface.

The assembly 462 is positioned within the well with the packer 464 disposed in the upper parent wellbore 20*d* and the packer 470 disposed in the lower parent wellbore 22*d*, and the tubular string 466 extending through the point of intersection or junction 14*d*. The valve 468 is positioned axially between the packers 464, 470, and the valve 472 and plug 474 are positioned below the packer 470 in the lower parent wellbore 22*d*. The packer 464 is set in the upper parent wellbore 20*d* and the packer 470 is set in the lower parent wellbore 22*d*.

Fluid 80*d* from the formation 44*d* may be permitted to flow into the interior of the tubing string 476 by opening the valve 468, or fluid 78*d* from the formation 46*d* may be permitted to flow into the interior of the tubing string 476 by opening the valve 472 or removing the plug 474, or both of the valves 468, 472 may be opened to establish fluid communication between the interior of the tubing string and both of the lower parent wellbore 22*d* and the lateral wellbore 16*d*. Removal of the plug 474 permits physical access to the lower parent wellbore 22*d*.

It will be readily apparent to one of ordinary skill in the art that where flow control devices, such as valves 40, 90, 438, 438*c*, 472 and plugs 38, 88, 440, 440*c*, 474 are used to control access to, and/or control fluid communication with, a portion of a wellbore in the various methods described herein, other combinations or arrangement of flow control devices may be utilized. For example, in the method 450 representatively illustrated in FIG. 20, in order to establish fluid communication between the interior of the tubular member 456 and the second wellbore portion 274*c* below the packer 282*c*, the plug 440*c* may be removed, and it is not necessary to also provide the valve 438*c* in the assembly 452. Therefore, it is to be understood that, in the methods described herein, substitutions, modifications, additions, deletions, etc. may be made to the flow control devices described as being utilized therewith, without departing from the principles of the present invention.

Again referring to FIG. 21, the tubular string 466 may be attached to the packer 470 by a releasable attachment member 478 (for example, a RATCH-LATCH®). In this manner, the tubing string 476, packer 464, valve 468, and tubular string 466 may be removed from the well, leaving the packer 470, valve 472, and plug 474 in the lower parent wellbore 22*d*, and thereby permitting enhanced physical access to the lateral wellbore 16*d* for remedial operations therein, etc. In this case, it will be readily appreciated that the whipstock 66 could be previously or subsequently attached to the packer 470. It will be further appreciated that the packer 470, valve 472, and plug 474 may correspond to the packer 28, valve 40, and plug 38 of the method 10 and, thus, these items of equipment need not be removed before initially installing the tubular string 466, valve 468 and packer 464 of the assembly 462 in the method 460.

Figure 22:
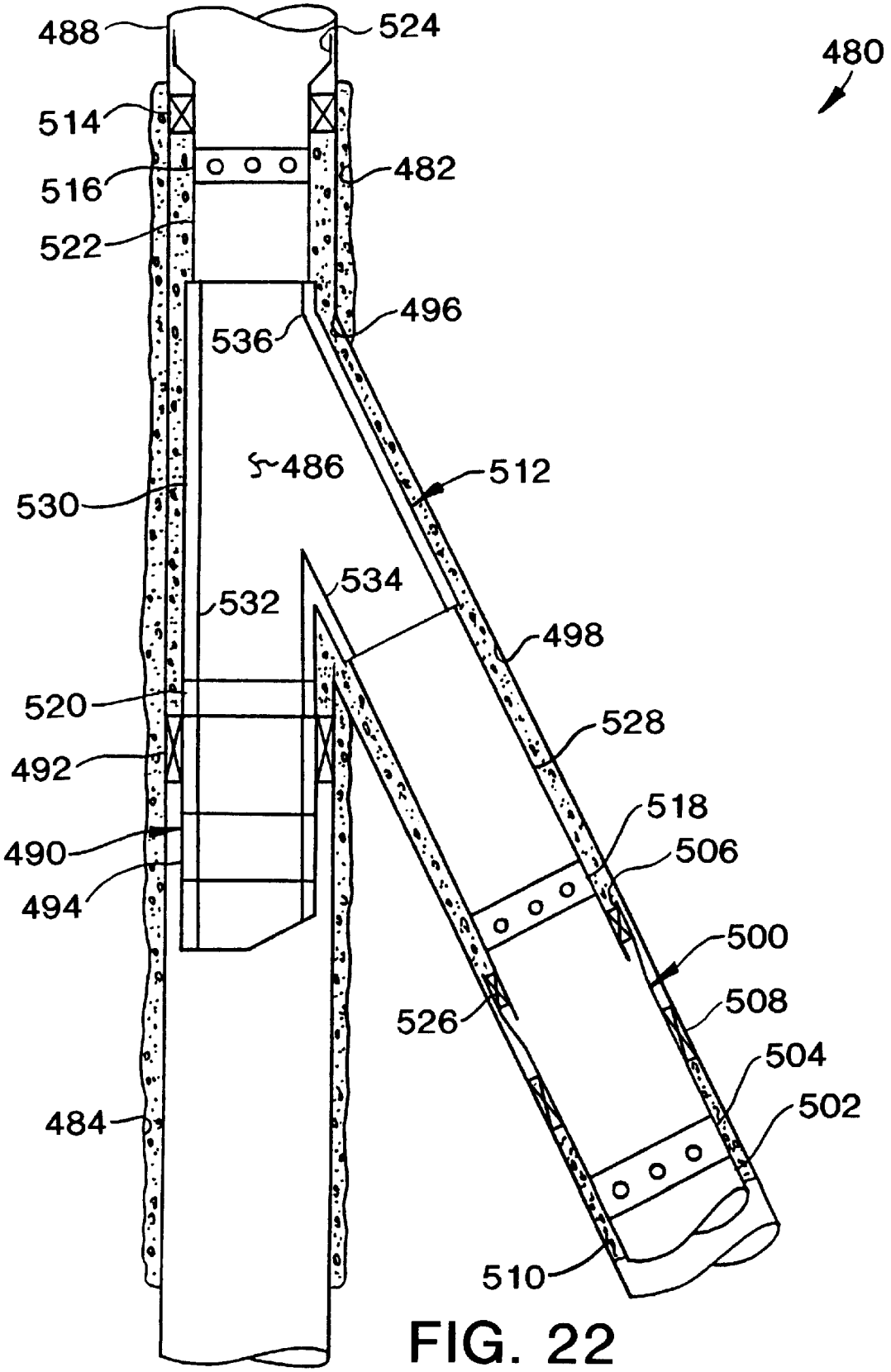
FIG. 22 is a schematic cross-sectional view of an eighth method of completing a subterranean well, wherein steps of the method have been performed, the method embodying principles of the present invention.

Referring additionally now to FIG. 22, a method 480 of completing a subterranean well embodying principles of the present invention is representatively and schematically illustrated. As shown in FIG. 22, some steps of the method 480 have already been performed.

A first wellbore portion 482 is drilled from the earth's surface, and a second wellbore portion 484 is drilled intersecting the first wellbore portion at an intersection or junction 486. A casing 488 is installed internally through the junction and cemented in place within the first and second wellbore portions 482, 484.

An assembly 490 is conveyed into the well. The assembly 490 includes a packer 492, a tubular structure 494 (which may be a mandrel of the packer, a separate tubular structure, etc.) attached to the packer, and a whipstock (not shown in FIG. 22, see FIG. 1) releasably attached to the packer, for example, by utilizing a releasable attachment member, such as a RATCH-LATCH®. The assembly 490 is positioned within the well, with the whipstock being adjacent the junction 486. The packer 492 is set in the second wellbore portion 484. An opening 496 is then formed through the casing 488 by deflecting a cutting tool off of the whipstock, and a third wellbore portion 498 is drilled extending outwardly from the opening 496.

Another assembly 500 is conveyed into the well. The assembly 500 includes a casing or liner 502, a valve 504 (for example, a valve of the type used in staged cementing operations), a seal surface 506 (for example, a seal bore, a polished bore receptacle, a packing stack or other seal, etc.), and a packer 508 (for example, an external casing packer). The assembly 500 is positioned within the third well portion 498 by lowering it through the first wellbore portion 482 and deflecting it off of the whipstock and through the opening 496 into the third well portion. The packer 508 is set in the third wellbore portion 498, the valve 504 is opened, and cement is flowed into an annulus 510 between the liner 502 and the third wellbore portion.

The whipstock is removed from the well by, for example, detaching it from the packer 492. An assembly 512 is then conveyed into the well. The assembly 512 includes a packer 514, two valves 516, 518 (for example, valves of the type utilized in staged cementing operations), an attachment portion 520 (for example, a RATCH-LATCH®), a seal surface 524 (for example, a seal bore, a polished bore receptacle, a packing stack or other seal, etc.), a sealing device 526 (for example, a packing stack or other seal, a packer, a polished seal surface, etc.), a tubular member 522 attached to the packer 514, seal surface 524 and valve 516, a tubular member 528 attached to the valve 518 and sealing device 526, and a device 530.

The device 530 includes three portals 530, 532, 534 an is shown somewhat enlarged in FIG. 22 for illustrative clarity. Of course, the device 530 should be dimensioned so that it is transportable within the first wellbore portion 482. The portal 532 is connected to the attachment portion 520, the portal 534 is connected to the tubular member 528, and the portal 536 is connected to the tubular member 522. As shown in FIG. 22, each of the portals 532, 534, 536 is in fluid communication with the others of them, but it is to be understood that flow control devices, such as plugs, valves, etc., may be conveniently installed in one or more of the portals to control fluid communication between selected ones of the portals.

The assembly 512 is positioned within the well with the device 530 disposed at the junction 486. The tubular member 528, valve 518, and sealing device 526 are inserted into the third wellbore portion 498. The sealing device is sealingly engaged with the seal surface 506. The attachment portion 520 is engaged with the packer 492. The packer 514 is set within the first wellbore portion 482. Note that the portal 532 could be sealingly engaged with the assembly 490 without the attachment portion 520 by providing a sealing device connected to the portal 532 and sealingly engaging the sealing device with the tubular structure 494.

At this point, the well surrounding the junction 486 is isolated from fluid communication with substantially all of the first, second and third wellbore portions 482, 484, 498. The packers 508, 492, 514 prevent such fluid communication. However, to provide further fluid isolation and to further secure the device 530 within the junction 486, the valves 516, 518 may be opened and cement or cementations material may be flowed between the device and the well surrounding the junction if desired.

Figure 23:
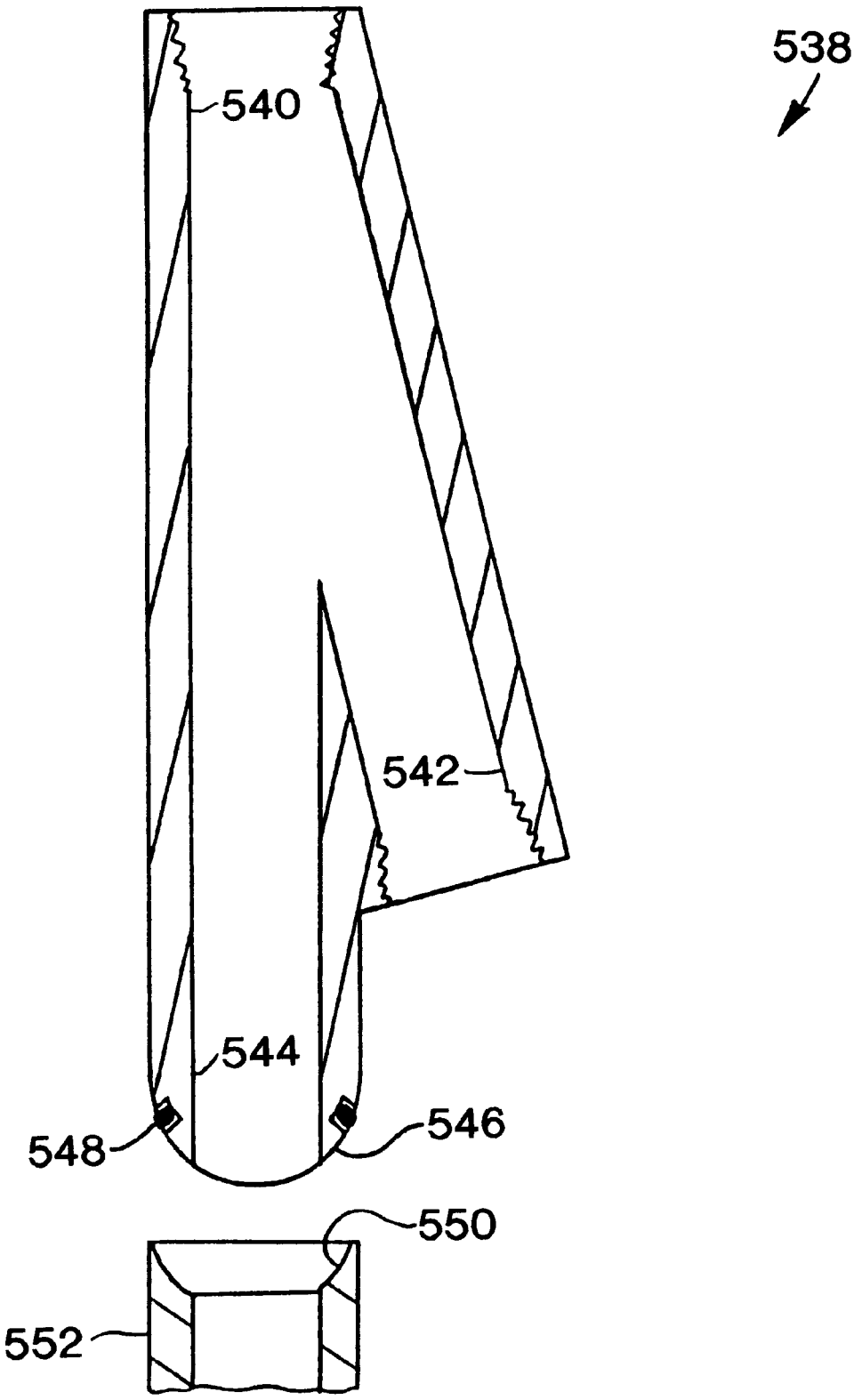
FIG. 23 is a cross-sectional view of an apparatus which may be utilized in the eighth method, the apparatus embodying principles of the present invention.

Referring additionally now to FIG. 23, another device 538 embodying principles of the present invention is representatively and schematically illustrated. The device 538 may be utilized in the method 480 in place of the device 530. The device 538 includes three portals 540, 542, 544. The portals 540, 542 are internally threaded, for example, for threaded and sealing attachment to the tubular members 522, 528, respectively.

The portal 544 has a circumferentially extending, generally convex spherical surface 546 formed externally thereabout. A circumferential seal 548 is carried on the surface 546. The surface 546 is complementarily shaped relative to a circumferentially extending and generally concave spherical surface 550 formed on a generally tubular member 552. The member 552 is preferably attached to the packer 492 prior to installation of the assembly 512 in the well, for example, the member 552 may be attached to the attachment portion 520 and engaged with the packer 492 after the whipstock is removed from the well. Alternatively, the member 552 may be a part of the packer 492 or attached thereto, so that it is installed in the well with the assembly 490.

When the assembly 512 is installed in the well, the surface 546 is sealingly engaged with the surface 550. Note that it is not necessary for the seal 548 to be included with the device 538, since the surfaces 546, 550 may sealingly engage each other, for example, with a metal-to-metal seal. It is also to be understood that the surfaces 546, 550 may be otherwise configured without departing from the principles of the present invention. Additionally, the surface 546 may be formed about the portal 542 or the portal 540 instead of, or in addition to, the portal 544, such that the mating surfaces 546, 550 are disposed at the connection to the tubular member 528 and/or at the connection to the tubular member 522.

Figure 24:
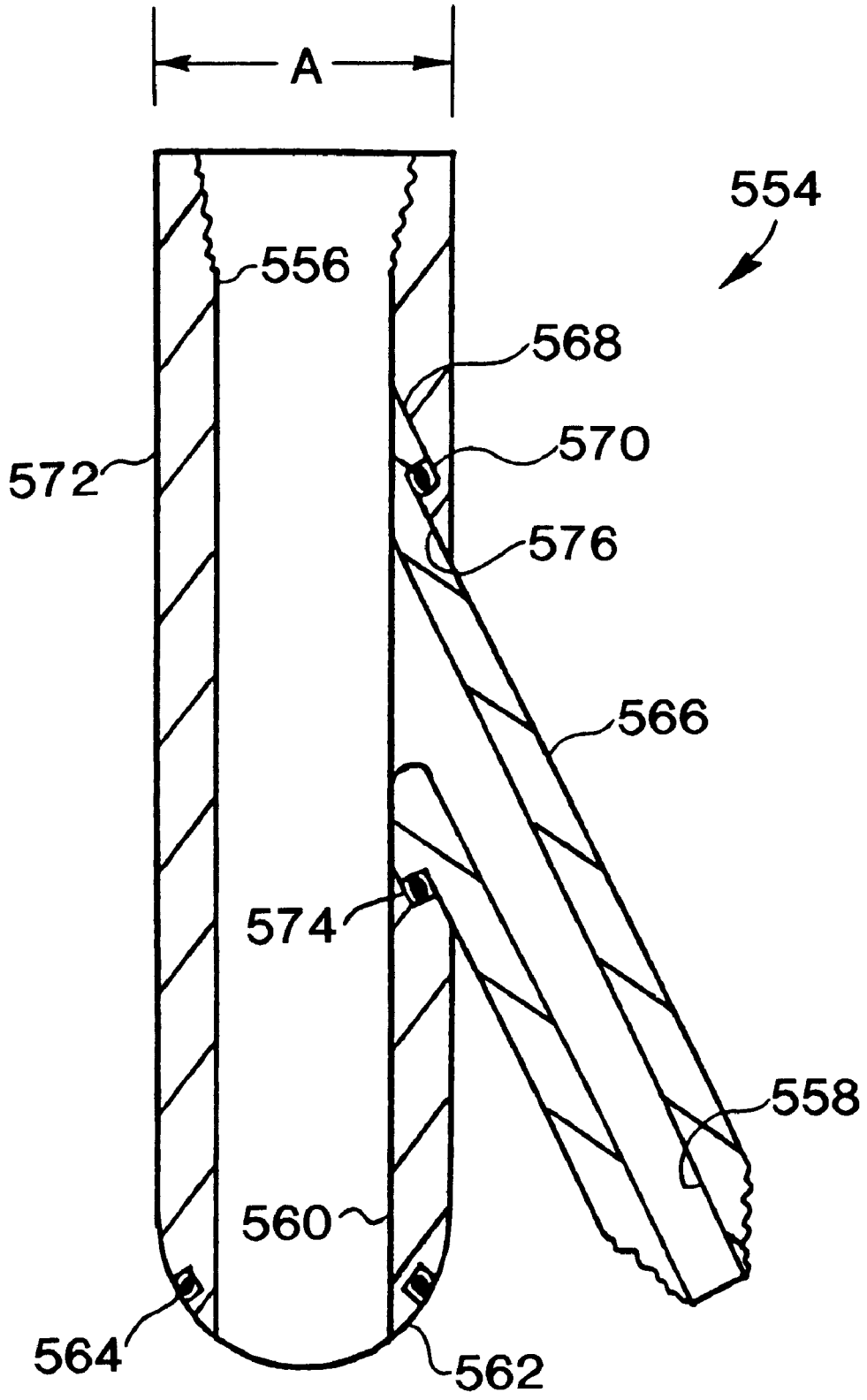
FIG. 24 is a cross-sectional view of an apparatus which may be utilized in the eighth method, the apparatus embodying principles of the present invention.

Referring additionally to FIG. 24, another device 554 embodying principles of the present invention is representatively and schematically illustrated. The device 554 may be utilized in the method 480 in place of the device 530. The device 554 includes three portals 556, 558, 560. The portal 556 is internally threaded, and the portal 558 is externally threaded, for example, for threaded and sealing attachment to the tubular members 522, 528, respectively.

The portal 560 has a circumferentially extending, generally convex spherical surface 562 formed externally thereabout. A circumferential seal 564 is carried on the surface 562. The surface 562 is complementarily shaped relative to the surface 550 formed on the member 552, which may be provided with the device 554. The member 552 may be utilized with the device 554 and installed in the well as previously described in relation to the device 538.

When the assembly 512 is installed in the well, the surface 562 is sealingly engaged with the surface 550. As with the device 538, the surface 562 may be formed on others of the portals 556, 558, the surface may be otherwise configured, and the seal 564 is not necessary for sealing engagement therewith.

In a unique aspect of the device 554, the portal 558 is formed within a separate tubular structure 566. The tubular structure has a radially enlarged end portion 568 which is received within a recess 570 formed internally on a body 572 of the device 554. A circumferential seal 574 sealingly engages the tubular structure 566 and the body 572.

The tubular structure 566 permits the body 572 to be separately conveyed into the well. In this manner, an outer dimension "A" of the body 572 may be made larger than outer dimensions of the device 538 or device 530, since the tubular structure 566 is not extending outwardly from the body when it is installed in the well. For example, the body 572 with the tubular member 522, valve 516, packer 516, and seal surface 524 connected at the portal 556 may be conveyed into the well, the surface 562 sealingly engaged with the surface 550, and the packer set in the first wellbore portion 482. Then, the tubular structure 566 with the tubular member 528, valve 518, and sealing device 526 connected at the portal 558 may be separately conveyed into the well, through the portal 556, into the body 572, and outward through a lateral opening 576, until the end portion 568 sealingly engages the recess 570.

Figure 25:
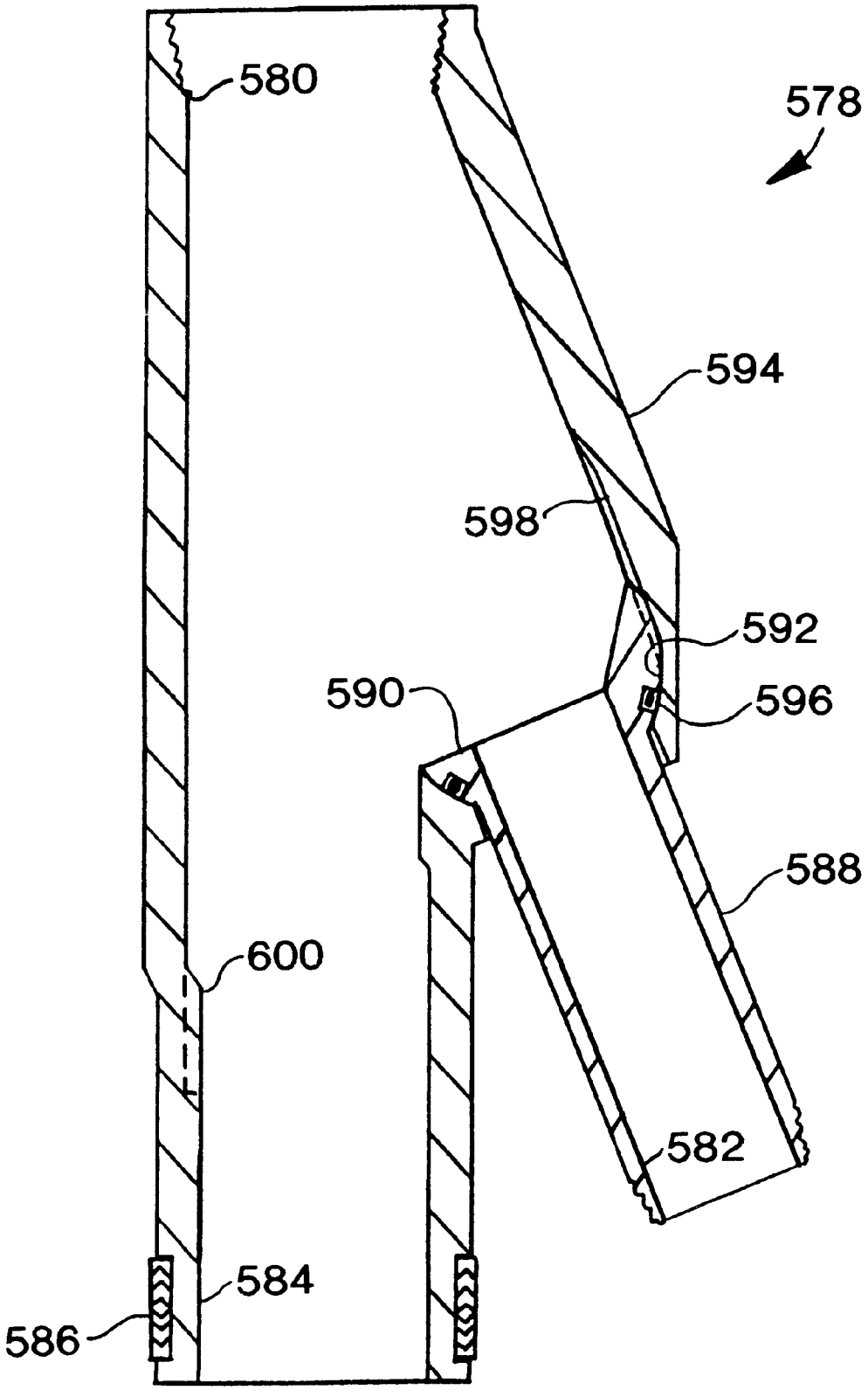
FIG. 25 is a cross-sectional view of an apparatus which may be utilized in the eighth method, the apparatus embodying principles of the present invention.

Referring additionally now to FIG. 25, a device 578 embodying principles of the present invention is representatively and schematically illustrated. The device 578 may be utilized in the method 480 in place of the device 530. The device 578 includes three portals 580, 582, 584. The portal 580 is internally threaded, and the portal 582 is externally threaded, for example, for threaded and sealing attachment to the tubular members 522, 528, respectively.

The portal 584 has a circumferential seal 586 carried externally thereabout. The seal 586 is configured for sealing engagement with the packer 492, or the tubular structure 494 attached thereto. Thus, when the device 578 is installed in the well, the seal 586 is inserted into the packer 492 and/or the tubular structure 494 for sealing engagement therewith.

In a manner somewhat similar to the device 554, the portal 582 is formed within a separate tubular structure 588. The tubular structure 588 has a radially enlarged end portion 590 which is received within a complementarily shaped recess 592 formed internally on a body 594 of the device 578. A circumferential seal 596 carried on the end portion 590 sealingly engages the tubular structure 588 and the body 594. Representatively, the end portion 590 and recess 592 are generally spherically shaped, in order to permit a range of angular alignment between the tubular structure 588 and the body 594 while still permitting sealing engagement between them. Additionally, internal keyways 598 and projections 600 may be provided internally on the body 594 for radial alignment of members inserted thereinto, selective passage of members therethrough, etc.

Installation of the device 578 is similar to the installation of the device 554 previously described. As with the device 554, the separate construction of the tubular structure 558 and body 594 permits the device 578 to be made larger than if it were constructed as a single piece.

Of course, a person of ordinary skill in the art would find it obvious to make certain modifications, additions, substitutions, etc., in the methods 10, 100, 190, 270, 430, 450, 460, 480 and their associated apparatus, and these are contemplated by the principles of the present invention. Accordingly, the foregoing detailed description is to be clearly understood as being given by way of illustration and example only, the spirit and scope of the present invention being limited solely by the appended claims.

What is claimed is:

1. Apparatus for use in completing a subterranean well, the apparatus comprising:

an anchoring device having at least first and second bores formed therethrough;

a first tubular string reciprocably received in the first bore; and a second tubular string in fluid communication with the second bore.

2. The apparatus according to claim 1, wherein the first tubular string has a curved shape.

3. The apparatus according to claim 2, wherein the first bore laterally restrains the curved shape of the first tubular string when it is received therein.

4. The apparatus according to claim 3, wherein the first tubular string is permitted to laterally deflect relative to the anchoring device when the curved shape is external to the first bore.

5. The apparatus according to claim 1, further comprising an orienting profile engaged with the second tubular string.

6. The apparatus according to claim 1, wherein the first tubular string is sealingly engageable with the anchoring device.

7. The apparatus according to claim 1, wherein the first tubular string has a curved shape and includes a sealing device, the curved shape laterally displacing the sealing device relative to the anchoring device when the first tubular string is displaced through the first bore.

8. Apparatus for use in completing a subterranean well, the apparatus comprising:

an anchoring device having at least first and second bores formed therethrough;

a first tubular string reciprocably received in a generally tubular housing attached to the anchoring device, the first tubular string having a precurved shape which is laterally restrained by the housing; and a second tubular string in fluid communication with the second bore.

9. The apparatus according to claim 8, wherein the anchoring device is a packer, and wherein the housing is attached to the packer coaxially with the first bore.

10. The apparatus according to claim 8, wherein the first tubular string includes a sealing device disposed on the first tubular string opposite the anchoring device from the housing, the sealing device scalingly engaging at least one of the housing and the anchoring device when the first tubular string is extended outwardly from the housing.

11. The apparatus according to claim 8, wherein the first tubular string is releasably secured against displacement relative to the housing.

12. The apparatus according to claim 8, wherein the second tubular string includes an orienting device configured for radially orienting the apparatus within the well.

13. The apparatus according to claim 8, wherein the first tubular string resumes its precurved shape when the first tubular string is extended outwardly from the housing.

14. The apparatus according to claim 8, wherein the first tubular string precured shape is substantially straightened when it is received in the housing, and wherein the first tubular string laterally deflects relative to the housing when the first tubular string is extended outwardly from the housing.

* * * * *